US011193689B2

(12) United States Patent
Turney et al.

(10) Patent No.: US 11,193,689 B2
(45) Date of Patent: Dec. 7, 2021

(54) BUILDING HVAC SYSTEM WITH PREDICTIVE TEMPERATURE AND HUMIDITY CONTROL

(71) Applicant: Johnson Controls Technology Company, Auburn Hills, MI (US)

(72) Inventors: Robert D. Turney, Watertown, WI (US); Liming Yang, Mequon, WI (US); Yunrui Wang, Milwaukee, WI (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 0 days.

(21) Appl. No.: 16/441,988

(22) Filed: Jun. 14, 2019

(65) Prior Publication Data

US 2020/0393157 A1 Dec. 17, 2020

(51) Int. Cl.

| | |
|---|---|
| ***F24F 11/63*** | (2018.01) |
| ***F24F 11/80*** | (2018.01) |
| ***F24F 11/67*** | (2018.01) |
| *F24F 110/20* | (2018.01) |
| *F24F 120/10* | (2018.01) |
| *F24F 110/10* | (2018.01) |

(52) U.S. Cl.

CPC ..... *F24F 11/63* (2018.01); *F24F 11/67* (2018.01); *F24F 11/80* (2018.01); *F24F 2110/10* (2018.01); *F24F 2110/20* (2018.01); *F24F 2120/10* (2018.01)

(58) Field of Classification Search

CPC ..... G24F 11/63; F24F 11/63
USPC ..... 700/276
See application file for complete search history.

(56) References Cited

U.S. PATENT DOCUMENTS 5,924,486 A * 7/1999 Ehlers ..... G05D 23/1923 165/238
7,580,775 B2 8/2009 Kulyk et al.
(Continued)

FOREIGN PATENT DOCUMENTS

EP 2 372 263 A2 10/2011

OTHER PUBLICATIONS

Erickson et al., "Occupancy Modeling and Prediction for Building Energy Management", ACM Transactions on Sensor Networks, Apr. 2014, pp. 42:1-28. (Year: 2014).*
(Continued)

*Primary Examiner* — Hien D Khuu
(74) *Attorney, Agent, or Firm* — Foley & Lardner LLP

(57) ABSTRACT

A predictive heating system for a building zone includes building equipment, a temperature sensor, a humidity sensor, and a predictive heating controller. The building equipment is operable to affect an environmental condition of the building zone in a heating mode of operation and a cooling mode of operation. The temperature sensor is configured to measure a temperature of the building zone. The humidity sensor is configured to measure humidify of the building zone. The predictive heating controller is configured to predict an occupancy time of the building zone over a future time period, determine a dehumidification time period before the occupancy time of the building zone, determine a heating time period before the occupancy time of the building zone, operate the building equipment to dehumidify the building zone over the dehumidification time period, and operate the building equipment to heat the building zone over the heating time period.

21 Claims, 15 Drawing Sheets

(56) References Cited

U.S. PATENT DOCUMENTS

| | | | | |
|---|---|---|---|---|
| 7,894,946 | B2 | 2/2011 | Kulyk et al. | |
| 8,527,108 | B2 | 9/2013 | Kulyk et al. | |
| 8,527,109 | B2 | 9/2013 | Kulyk et al. | |
| 8,918,223 | B2 | 12/2014 | Kulyk et al. | |
| 9,110,647 | B2 | 8/2015 | Kulyk et al. | |
| 9,429,923 | B2 | 8/2016 | Ward et al. | |
| 9,703,339 | B2 | 7/2017 | Kulyk et al. | |
| 10,139,877 | B2 | 11/2018 | Kulyk et al. | |
| 10,282,796 | B2 | 5/2019 | Elbsat et al. | |
| 2012/0065783 | A1* | 3/2012 | Fadell | F24F 11/62 700/276 |
| 2014/0319231 | A1* | 10/2014 | Matsuoka | G05D 23/1902 236/51 |
| 2014/0365017 | A1 | 12/2014 | Hanna et al. | |
| 2015/0167999 | A1* | 6/2015 | Seem | F24F 11/30 700/276 |
| 2015/0168002 | A1* | 6/2015 | Plitkins | F24F 11/70 165/237 |
| 2015/0168003 | A1* | 6/2015 | Stefanski | F24F 11/70 165/237 |
| 2016/0377305 | A1* | 12/2016 | Kwa | F24F 11/30 700/277 |
| 2017/0074539 | A1 | 3/2017 | Bentz et al. | |
| 2017/0074541 | A1 | 3/2017 | Bentz et al. | |
| 2017/0075510 | A1 | 3/2017 | Bentz et al. | |
| 2018/0196456 | A1 | 7/2018 | Elbsat | |
| 2018/0224814 | A1 | 8/2018 | Elbsat et al. | |
| 2018/0285800 | A1 | 10/2018 | Wenzel et al. | |
| 2019/0377305 | A1* | 12/2019 | Petrus | G05B 15/02 |

OTHER PUBLICATIONS

Ward et al., "Beyond Comfort—Managing the Impact of HVAC Control on the Outside World," Proceedings of Conference: Air Conditioning and the Low Carbon Cooling Challenge, Cumberland Lodge, Windsor, UK, London: Network for Comfort and Energy Use in Buildings, http://nceub.org.uk, Jul. 27-29, 2008, 15 pages.

International Search Report and Written Opinion on PCT/US2020/037599, dated Sep. 28, 2020, 14 pages.

* cited by examiner

BUILDING HVAC SYSTEM WITH PREDICTIVE TEMPERATURE AND HUMIDITY CONTROL

BACKGROUND

The present disclosure relates generally to maintaining comfortable environmental conditions in a building zone. More particularly, the present disclosure relates to efficiently maintaining relative humidity and temperature of a building zone at comfortable/acceptable values when the building zone is occupied.

SUMMARY

One implementation of the present disclosure is a predictive heating system for a building zone, according to some embodiments. The system includes building equipment, a temperature sensor, a humidity sensor, and a predictive heating controller, according to some embodiments. The building equipment is operable to affect an environmental condition of the building zone in a heating mode of operation and a cooling mode of operation, according to some embodiments. The temperature sensor is configured to measure a temperature of the building zone, according to some embodiments. The humidity sensor is configured to measure humidify of the building zone, according to some embodiments. The predictive heating controller is configured to predict an occupancy time of the building zone over a future time period, determine a dehumidification time period before the occupancy time of the building zone, determine a heating time period before the occupancy time of the building zone, operate the building equipment to dehumidify the building zone over the dehumidification time period, and operate the building equipment to heat the building zone over the heating time period, according to some embodiments.

In some embodiments, the predictive heating controller is configured to receive occupancy schedules from a scheduling service to estimate when the building zone will be occupied.

In some embodiments, the system also includes an occupancy sensor. In some embodiments, the predictive heating controller is further configured to collect occupancy sensor information from the occupancy sensor over a time period, generate a model that predicts occupancy of the building zone, and use the model to predict occupancy of the building zone to estimate times that the building zone is occupied.

In some embodiments, the predictive heating controller is configured to use both the received occupancy schedules and the occupancy of the building zone predicted by the model to predict occupancy of the building zone over the future time period.

In some embodiments, the building equipment is single-coil building equipment configured to operate in the cooling mode of operation or the heating mode of operation.

In some embodiments, the predictive heating controller is configured to receive a user input from a user interface. The user input is a command to activate the predictive heating controller to operate the building equipment to dehumidify the building zone and operate the building equipment to heat the building zone, according to some embodiments.

Another implementation of the present disclosure is a predictive heating controller for a building zone, according to some embodiments. In some embodiments, the controller is configured to predict an occupancy time of the building zone over a future time period, determine a dehumidification time period before the occupancy time of the building zone, determine a heating time period before the occupancy time of the building zone, operate building equipment to dehumidify the building zone over the dehumidification time period, and operate the building equipment to heat the building zone over the heating time period.

In some embodiments, the controller is configured to operate the building equipment to dehumidify the building zone and operate the building equipment to heat the building zone at least partially before the occupancy time of the building zone.

In some embodiments, the controller is configured to receive humidity measurements of the building zone from a humidity sensor, receive temperature measurements of the building zone from a temperature sensor, operate the building equipment to dehumidify the building zone over the dehumidification time period until the relative humidity measurement of the building zone is less than a humidity threshold value, and operate the building equipment to heat the building zone over the heating time period until the temperature measurement of the building zone is within an acceptable temperature range.

In some embodiments, the controller is configured to receive occupancy schedules from a scheduling service to estimate when the building zone will be occupied.

In some embodiments, the controller is further configured to collect occupancy sensor information from an occupancy sensor over a time period, generate a model that predicts occupancy of the building zone, and use the model to predict occupancy of the building zone to estimate times that the building zone is occupied.

In some embodiments, the controller is further configured to use both the received occupancy schedules and the occupancy of the building zone predicted by the model to predict occupancy of the building zone over the future time period.

In some embodiments, the building equipment is single-coil building equipment configured to operate in the cooling mode of operation or the heating mode of operation.

In some embodiments, the controller is configured to receive a user input from a user interface. The user input is a command to activate the predictive heating controller to operate the building equipment to dehumidify the building zone and operate the building equipment to heat the building zone, according to some embodiments.

Another implementation of the present disclosure is a method for dehumidifying and heating a building zone, according to some embodiments. In some embodiments, the method includes predicting an occupancy time of the building zone over a future time period. In some embodiments, the method further includes determining a dehumidification time period before the occupancy time of the building zone and determining a heating time period before the occupancy time of the building zone. In some embodiments, the method includes operating the building equipment in a cooling mode to dehumidify the building zone over the dehumidification time period, and operating the building equipment in a heating mode to heat the building zone over the heating time period.

In some embodiments, the method further includes receiving occupancy schedules from a scheduling service to estimate when the building zone will be occupied.

In some embodiments, the method further includes collecting occupancy sensor information from an occupancy sensor over a time period, generating a model that predicts occupancy of the building zone, and using the model to predict occupancy of the building zone to estimate times that the building zone is occupied.

In some embodiments, the method further includes using both the received occupancy schedules and the occupancy of the building zone predicted by the model to predict occupancy of the building zone over the future time period.

In some embodiments, the building equipment is single-coil building equipment configured to operate in the cooling mode of operation or the heating mode of operation.

In some embodiments, the method further includes receiving a user input from a user interface, wherein the user input is a command to activate operation of the building equipment to dehumidify the building zone and to heat the building zone.

DETAILED DESCRIPTION

Overview

Figure 1A:
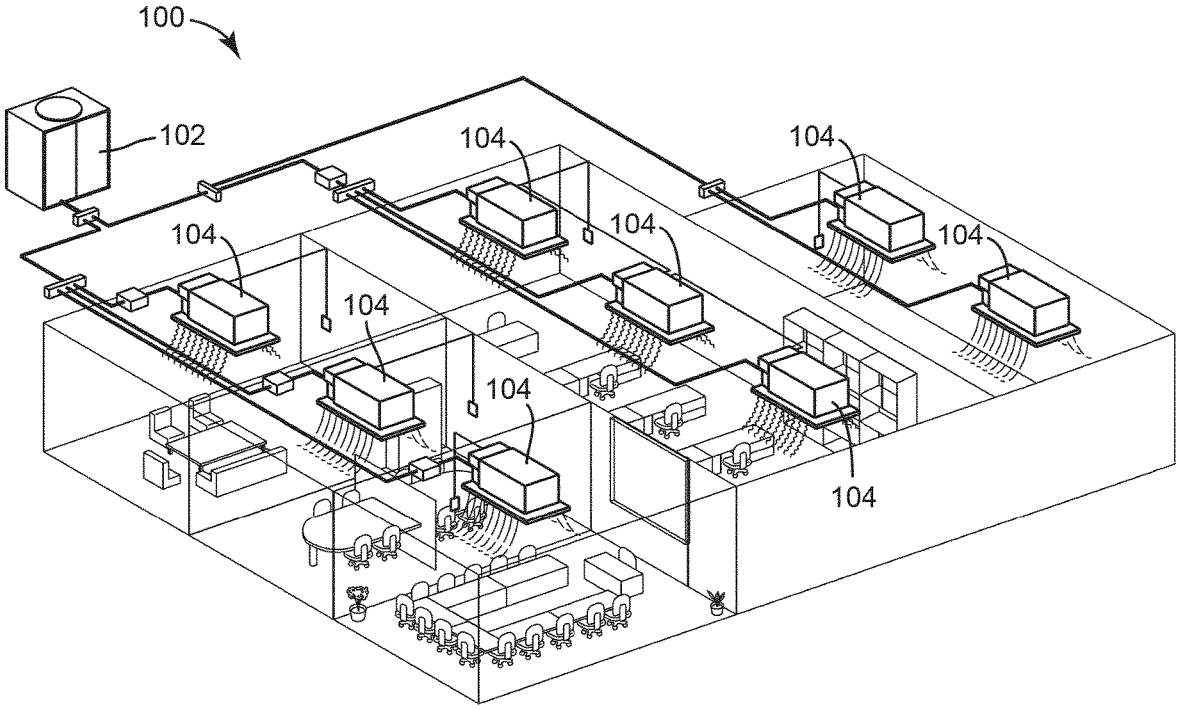
FIGS. 1A-1B are drawings of a variable refrigerant flow (VRF) system having one or more outdoor VRF units and a plurality of indoor VRF units, according to some embodiments.

Referring generally to the FIGURES, a predictive heating system is shown according to various exemplary embodiments. The predictive heating system includes equipment that is operable in a cooling/dehumidification mode and a heating mode. The equipment can be used to provide both cooling/dehumidification and heating, depending on a current operating mode. The cooling and dehumidification performed by the equipment results from a same mode of operation such that cooling and dehumidification occur simultaneously or concurrently, according to some embodiments. In order to provide both dehumidification and heating, the predictive heating system can change/transition the equipment between the cooling/dehumidification mode and the heating mode to maintain both temperature and humidity within comfortable ranges.

The equipment is configured to serve a building zone, a room of a building, a space, etc., to heat and/or cool the building zone when in the various modes. In some embodiments, the equipment is also configured to operate in a standby mode where heating/cooling/dehumidification is not provided to the building zone, but the equipment is activated. In some embodiments, the predictive heating system includes one or more humidity sensors and one or more temperature sensors. The humidity sensors can be configured to measure/monitor the humidity (e.g., the relative humidity) of the building zone and provide a predictive heating controller with the measured/monitored humidity. The temperature sensors are configured to measure/monitor the temperature in the building zone and provide the predictive heating controller with the measured/monitored temperature readings. In some embodiments, the predictive heating system includes an occupancy sensor configured to detect occupancy of the building zone and provide the predictive heating controller with the detected occupancy.

The predictive heating controller can also receive occupancy, work, reservation, etc., schedules to predict when the building zone will be occupied. The predictive heating controller can also record occupancy sensor data received from the occupancy sensor over a time duration and generate an occupancy model. The predictive heating controller can use the occupancy model to predict occupancy of the building zone in the future. For example, the occupancy model can be used to predict busy times of day when the building zone will likely be occupied, even if occupancy is not scheduled for that time.

The predictive heating controller can operate the equipment to satisfy various environmental conditions before the building zone becomes occupied. For example, the predictive heating controller may determine a dehumidification time period and a heating time period. Over the dehumidification time period the predictive heating controller can operate the equipment in the cooling/dehumidification mode to decrease the relative humidity of the building zone. Once the relative humidity of the building zone is at an acceptable/ comfortable value, the predictive heating controller can operate the equipment in the heating mode over the heating time period to raise/increase the temperature of the building zone to an acceptable/comfortable temperature.

The predictive heating controller can predict occupancy of the building, and operate single-coil equipment so that the relative humidity and the temperature of the building zone are comfortable before the building zone becomes occupied. Advantageously, the predictive heating controller can be used with less-expensive equipment to maintain comfortable conditions in the building zone.

Variable Refrigerant Flow System

Figure 1B:
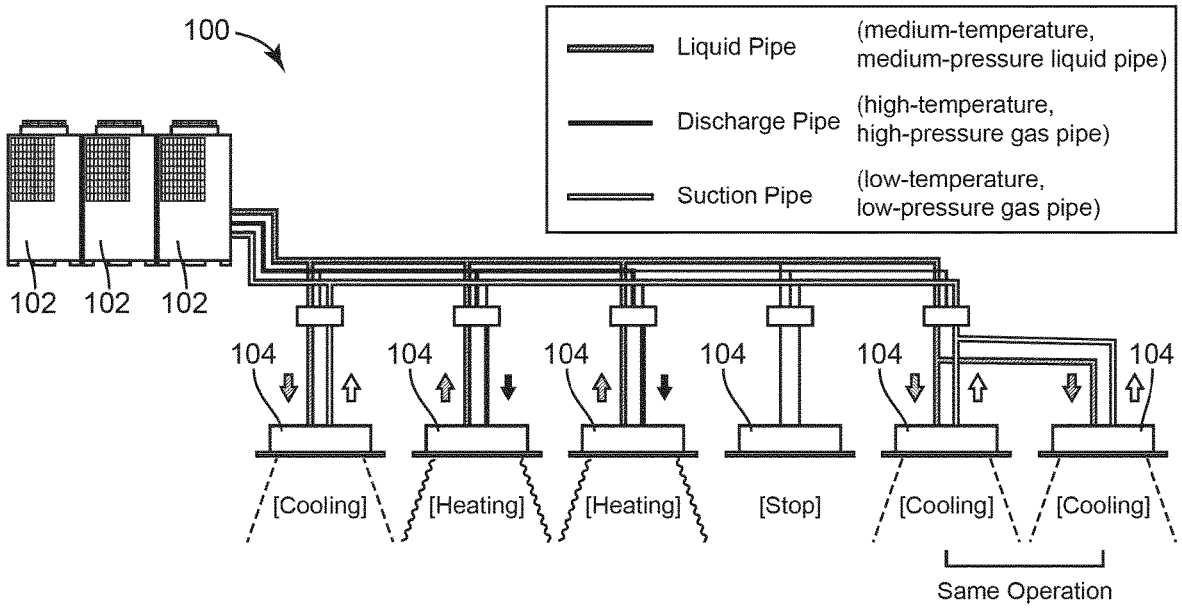

Referring now to FIGS. 1A-1B, a variable refrigerant flow (VRF) system 100 is shown, according to some embodiments. VRF system 100 is shown to include a plurality of outdoor VRF units 102 and a plurality of indoor VRF units 104. Outdoor VRF units 102 can be located outside a building and can operate to heat or cool a refrigerant. Outdoor VRF units 102 can consume electricity to convert refrigerant between liquid, gas, and/or super-heated gas phases. Indoor VRF units 104 can be distributed throughout various building zones within a building and can receive the heated or cooled refrigerant from outdoor VRF units 102. Each indoor VRF unit 104 can provide temperature control for the particular building zone in which the indoor VRF unit is located.

A primary advantage of VRF systems is that some indoor VRF units 104 can operate in a cooling mode while other indoor VRF units 104 operate in a heating mode. For example, each of outdoor VRF units 102 and indoor VRF units 104 can operate in a heating mode, a cooling mode, or an off mode. Each building zone can be controlled independently and can have different temperature setpoints. In some embodiments, each building has up to three outdoor VRF units 102 located outside the building (e.g., on a rooftop) and up to 128 indoor VRF units 104 distributed throughout the building (e.g., in various building zones).

Many different configurations exist for VRF system 100. In some embodiments, VRF system 100 is a two-pipe system in which each outdoor VRF unit 102 connects to a single refrigerant return line and a single refrigerant outlet line. In a two-pipe system, all of the outdoor VRF units 102 operate in the same mode since only one of a heated or chilled refrigerant can be provided via the single refrigerant outlet line. In other embodiments, VRF system 100 is a three-pipe system in which each outdoor VRF unit 102 connects to a refrigerant return line, a hot refrigerant outlet line, and a cold refrigerant outlet line. In a three-pipe system, both heating and cooling can be provided simultaneously via the dual refrigerant outlet lines. An example of a three-pipe VRF system which can be used for VRF system 100 is described in detail below.

Figure 2A:
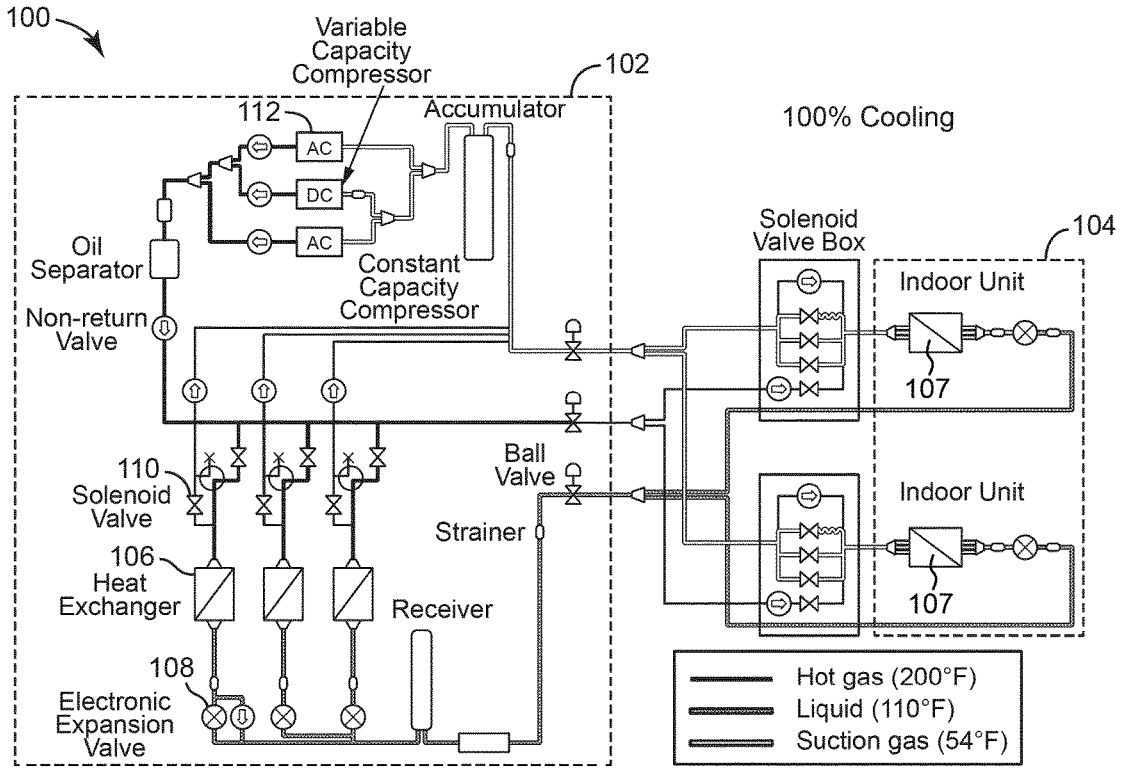
FIG. 2A is a diagram illustrating the operation of the VRF system of FIGS. 1A-1B in a cooling mode, according to some embodiments.
Figure 2B:
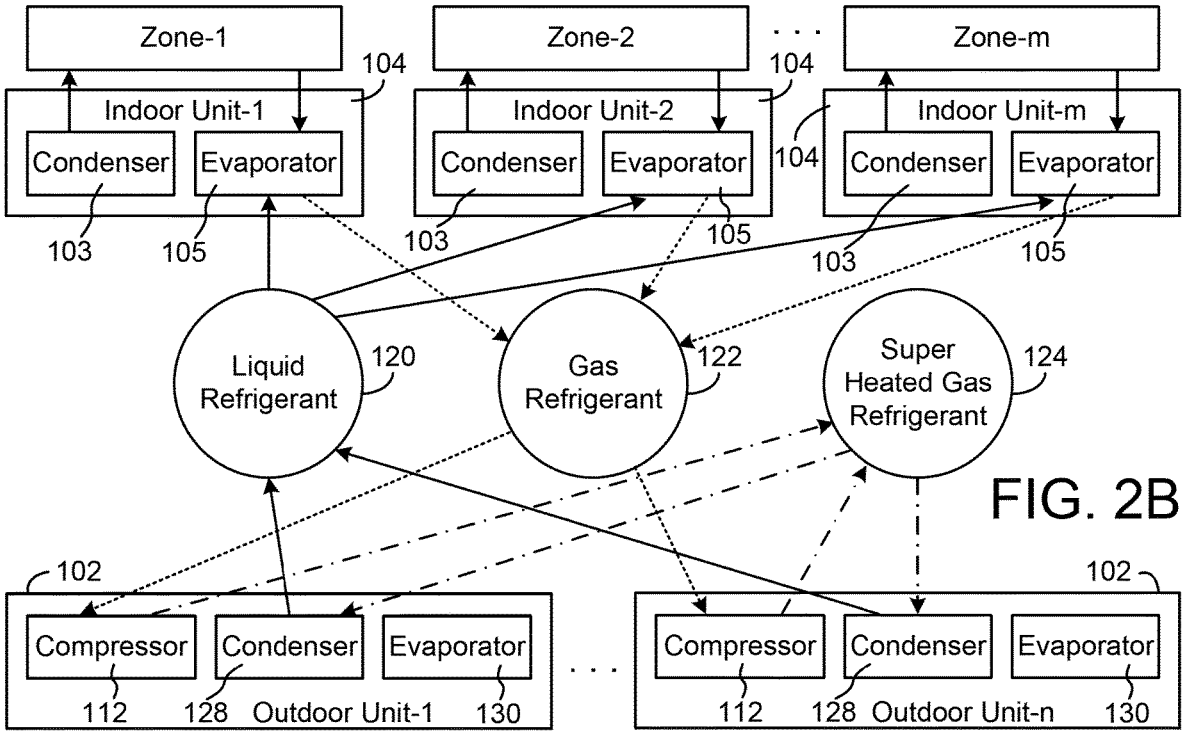
FIG. 2B is a directed graph illustrating the balance of refrigerant states when the VRF system operates in the cooling mode, according to some embodiments.
Figure 3A:
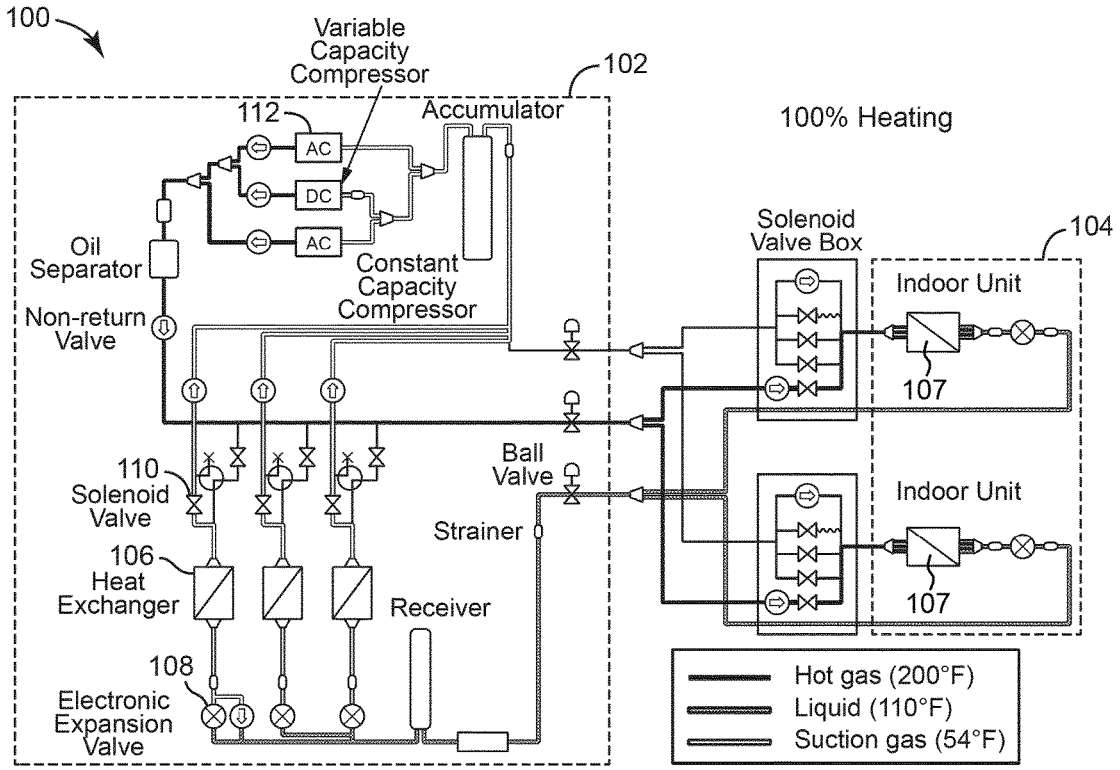
FIG. 3A is a diagram illustrating the operation of the VRF system of FIGS. 1A-1B in a heating mode, according to some embodiments.
Figure 3B:
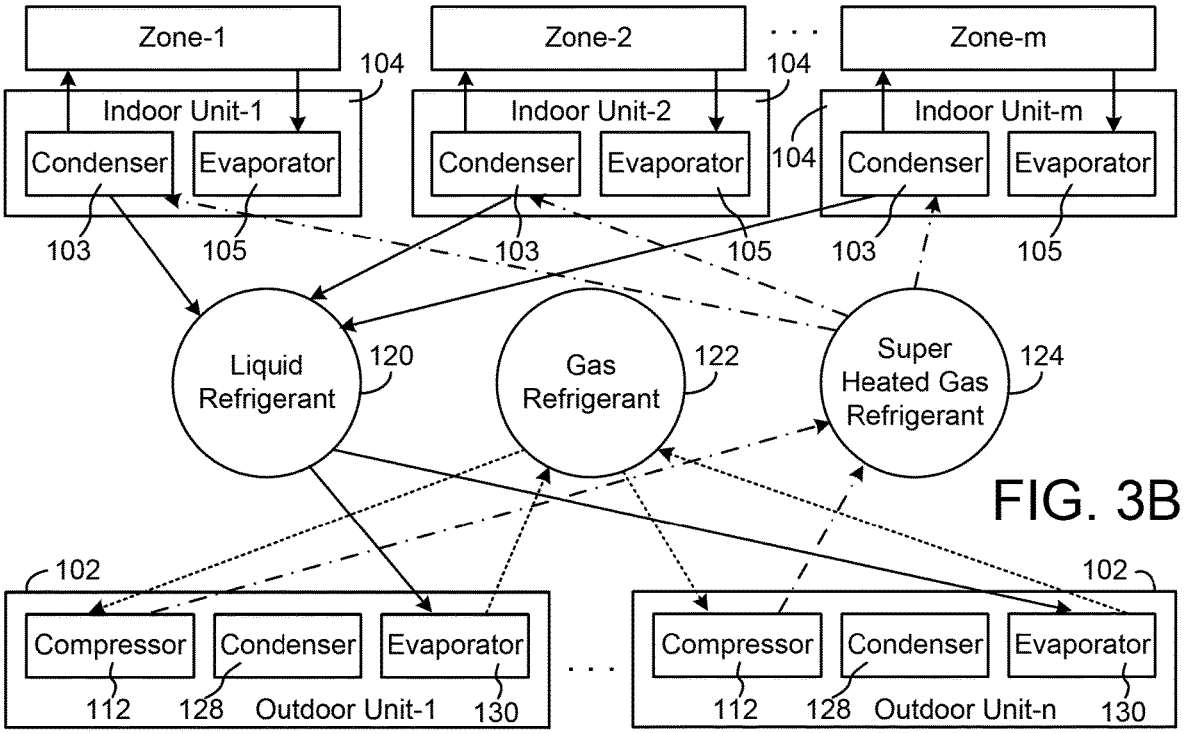
FIG. 3B is a directed graph illustrating the balance of refrigerant states when the VRF system operates in the heating mode, according to some embodiments.
Figure 4A:
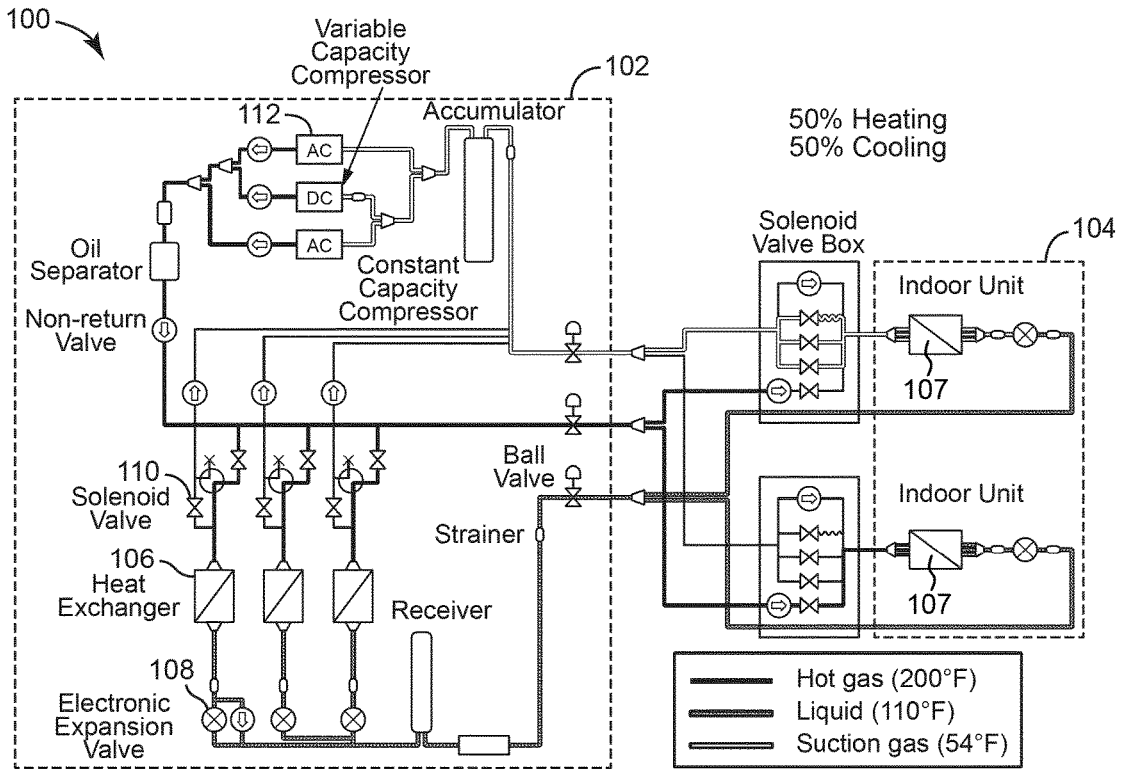
FIG. 4A is a diagram illustrating the operation of the VRF system of FIGS. 1A-1B in a combined heating and cooling mode, according to some embodiments.
Figure 4B:
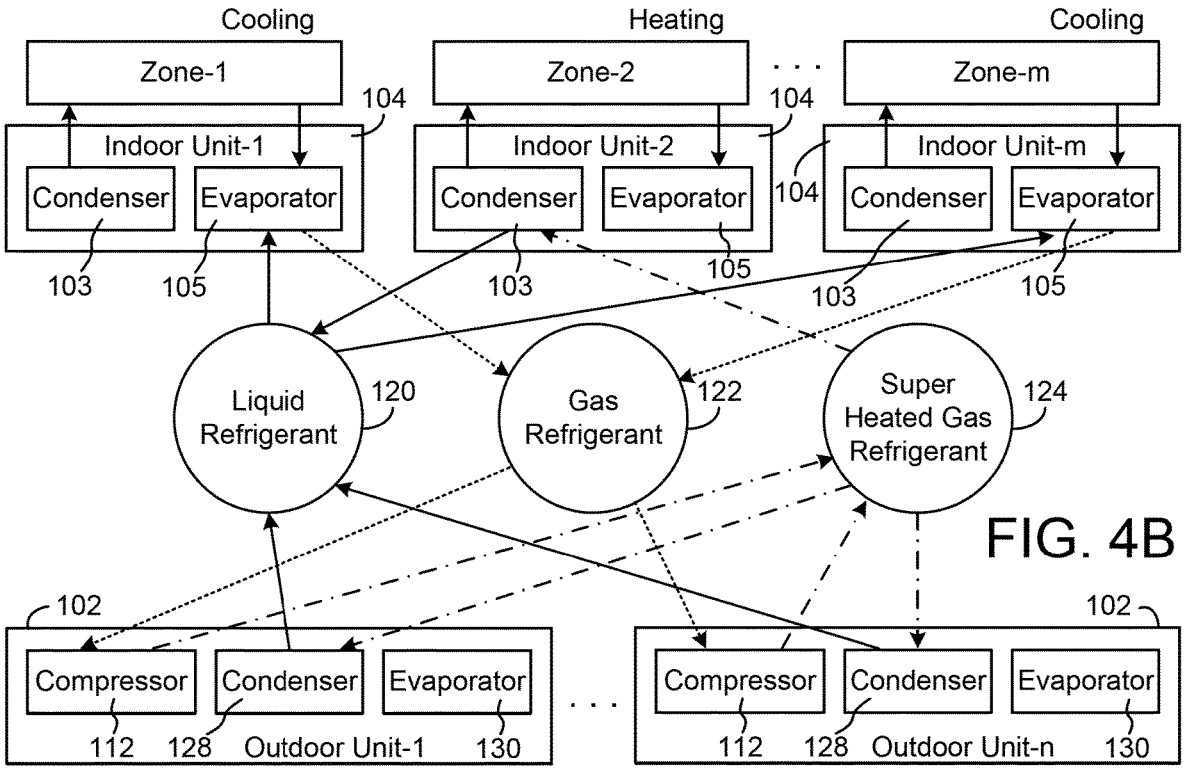
FIG. 4B is a directed graph illustrating the balance of refrigerant states when the VRF system operates in the combined heating and cooling mode, according to some embodiments.

Referring now to FIGS. 2A-4B, several diagrams illustrating the operation of VRF system 100 in a cooling mode, a heating mode, and a combined heating/cooling mode are shown, according to some embodiments. Each outdoor VRF unit 102 may include one or more heat exchangers 106 (as shown in FIGS. 2A, 3A, and 4A). When outdoor VRF units 102 operate in a cooling mode, heat exchangers 106 can operate as condensers 128 (as shown in FIGS. 2B and 4B) to provide cooling for the refrigerant. When outdoor VRF units 102 operate in a heating mode, heat exchangers 106 can be operated as evaporators 130 (as shown in FIG. 3B) to provide heating for the refrigerant. It is contemplated that condensers 128 and evaporators 130 may exist as separate devices within outdoor VRF units 102 or may exist as heat exchangers 106 which can be operated as both condensers 128 and evaporators 130 depending on the mode of operation of outdoor VRF units 102. Although only two outdoor VRF units 102 are shown, it should be understood that VRF system 100 can include any number n of outdoor VRF units 102.

Each indoor VRF unit 104 may include one or more heat exchangers 107 (as shown in FIGS. 2A, 3A, and 4A) When indoor VRF units 104 operate in a cooling mode, heat exchangers 107 can operate as evaporators 105 (as shown in FIGS. 2B and 4B) to provide cooling for the air delivered to the building zones. When indoor VRF units 104 operate in a heating mode, heat exchangers 107 can be operated as condensers 103 (as shown in FIG. 3B) to provide heating for the air delivered to the building zones. It is contemplated that condensers 103 and evaporators 105 may exist as separate devices within indoor VRF units 104 or may exist as heat exchangers 107 which can be operated as both condensers 103 and evaporators 105 depending on the mode of operation of indoor VRF units 104. Although only three indoor VRF units 104 are shown, it should be understood that VRF system 100 can include any number m of indoor VRF units 104.

Referring particularly to FIGS. 2A-2B, the operation of VRF system 100 in the cooling mode is shown, according to some embodiments. In the cooling mode, heat exchangers 106 of outdoor VRF units 102 operate as condensers 128 to condense a superheated gas refrigerant 124 into a liquid refrigerant 120. The liquid refrigerant 120 from heat exchangers 106 flows through the expansion valves (EEV) 108 and on to heat exchangers 107 of indoor VRF units 104. In the cooling mode, heat exchangers 107 operate as evaporators 105 to evaporate the liquid refrigerant 120 to a gas refrigerant 122, thereby absorbing heat from the air within the building zones and providing cooling for the building zones. Solenoid valves 110 allow for the gas refrigerant 122 to return to one or more compressors 112 of outdoor units 102. Compressors 112 compress the gas refrigerant 122 to create a superheated gas refrigerant 124, which is provided to condensers 128.

Referring now to FIGS. 3A-3B, the operation of VRF system 100 in the heating mode is shown, according to some embodiments. In the heating mode, heat exchangers 106 of outdoor VRF units 102 operate as evaporators 130 to evaporate the liquid refrigerant 120 from the indoor VRF units 104. Heat exchangers 106 transfer heat into the liquid refrigerant 120, thereby causing the liquid refrigerant 120 to evaporate and form a gas refrigerant 122. The gas refrigerant 122 is provided to compressors 112, which compress the gas refrigerant 122 to form a superheated gas refrigerant 124. The superheated gas refrigerant 124 is then provided to heat exchangers 107 of indoor VRF units 104. Heat exchangers 107 operate as condensers 102 to condense the superheated gas refrigerant 124 by transferring heat from the superheated gas refrigerant 124 to the building zones, thereby causing the superheated gas refrigerant 124 to lose heat and become the liquid refrigerant 120. The liquid refrigerant 120 is then returned to heat exchangers 106 outdoor VRF units 102.

Referring now to FIGS. 4A-4B, the operation of VRF system 100 in a combined heating and cooling mode is shown, according to some embodiments. In the combined heating/cooling model, some indoor and outdoor VRF units 102-104 operate in a heating mode while other indoor and outdoor VRF units 102-104 operate in a cooling mode. For example, indoor VRF unit-2 is shown operating in a heating mode, whereas indoor VRF unit-1 and indoor VRF unit-m are shown operating in the cooling mode. Both outdoor VRF unit-1 and outdoor VRF unit-n are shown operating in the cooling mode.

The operation of outdoor VRF units 102 in the cooling mode can be the same as previously described with reference to FIGS. 2A-2B. For example, outdoor VRF units 102 can receive the gas refrigerant 122 and condense the gas refrigerant 122 into a liquid refrigerant 120. The liquid refrigerant 120 can be routed to indoor VRF unit-1 and indoor VRF unit-m to provide cooling for zone-1 and zone-m. Heat exchangers 107 of indoor VRF unit-1 and indoor VRF unit-m operate as evaporators 105, by absorbing heat from building zone-1 and building zone-m, thereby causing the liquid refrigerant 120 to become a gas refrigerant 122. The gas refrigerant 122 is then delivered to compressors 112 of outdoor VRF units 1022. Compressors 112 compress the gas refrigerant 122 to form a superheated gas refrigerant 124. The superheated gas refrigerant 124 can be provided to heat exchangers 106 of outdoor VRF units 102, which operate as condensers 128 to condense the gas refrigerant 122 to liquid refrigerant 120. The superheated gas refrigerant 124 can also be provided to indoor VRF unit-2 and used to provide heating to building zone-2.

The operation of indoor VRF unit-2 in the heating mode can be the same as previously described with reference to FIGS. 3A-3B. For example, heat exchanger 107 of indoor VRF unit-2 can operate as a condenser 103 by rejecting heat from the superheated gas refrigerant 124 to building zone-2, thereby causing the superheated gas refrigerant 124 to become a liquid refrigerant 120. The liquid refrigerant 120 can be routed to heat exchangers 107 of indoor VRF unit-1 and indoor VRF unit-m, which operate as evaporators 105 to absorb heat from building zone-1 and building zone-m, as previously described.

In any of the operating modes, VRF system 100 can operate to ensure that the refrigerant states remain balanced. For example, when operating in the cooling mode, VRF system 100 can operate outdoor VRF units 102 and indoor VRF units 104 to ensure that outdoor VRF units 102 convert the gas refrigerant 122 to the liquid refrigerant 120 at the same rate that indoor VRF units 104 convert the liquid refrigerant 120 to the gas refrigerant 122. Similarly, when operating in the heating mode, VRF system 100 can operate outdoor VRF units 102 and indoor VRF units 104 to ensure that outdoor VRF units 102 convert the liquid refrigerant 120 to the superheated gas refrigerant 124 at the same rate that indoor VRF units 104 convert the superheated gas refrigerant 124 to the liquid refrigerant 120.

In each of the operating modes, VRF system 100 can operate outdoor VRF units 102 and indoor VRF units 104 to ensure that the amount of each refrigerant state produced (e.g., liquid refrigerant 120, gas refrigerant 122, and superheated gas refrigerant 124) by outdoor VRF units 102 and indoor VRF units 104 is equal to the amount of each refrigerant state consumed by outdoor VRF units 102 and indoor VRF units 104. In other words, VRF system 100 can balance the rates at which refrigerant is added and removed from each of the refrigerant states. In some embodiments, VRF system 100 imposes mass balance constraints or volume balance constraints to ensure that the net amount of refrigerant in each of the refrigerant states remains balanced at each time step of an optimization period.

In some embodiments, VRF system 100 is controlled using a predictive energy cost optimization framework. For example, VRF system 100 can include one or more controllers which perform a high-level optimization and a low-level optimization. The high-level optimization can seek to optimize the electricity usage costs plus the peak electricity charge (i.e., the electricity demand charge) across the entire VRF system 100 subject to several system constraints by manipulating the requested cooling or heating duty delivered to each zone and the operation modes of the indoor and outdoor VRF units 102-104. The constraints imposed in the high-level optimization can include system constraints such as the balance of refrigerant states (as previously described) and zone temperature constraints. The zone temperature constraints can require the temperature of each building zone to be maintained within an acceptable temperature range to maintain comfort of the occupants.

The low-level optimization can use the requested heating and cooling duty for each building zone computed by the high-level optimization as input data to the low-level optimization. The low-level optimization can manipulate the zone temperature setpoints for the various building zones such that the zone heating and cooling duties track the requested heating or cooling duty profile computed in the high-level optimization.

In some embodiments, the low-level optimization is distributed across several low-level model predictive controllers, each of which can operate to determine the temperature setpoints for a particular building zone. For example, the control system can include a high-level model predictive controller (MPC) and several low-level MPCs. The high-level MPC can determine an optimal load profile for each of the building zones and can distribute the optimal load profiles to the low-level MPCs for the building zones. Each low-level MPC can be configured to control a particular building zone and can receive the load profile for the corresponding building zone from the high-level MPC. Each low-level MPC can determine optimal temperature setpoints for the corresponding building zone using the load profile from the high-level MPC. An example of such a distributed implementation is described in greater detail with reference to FIG. 6.

Figure 5:
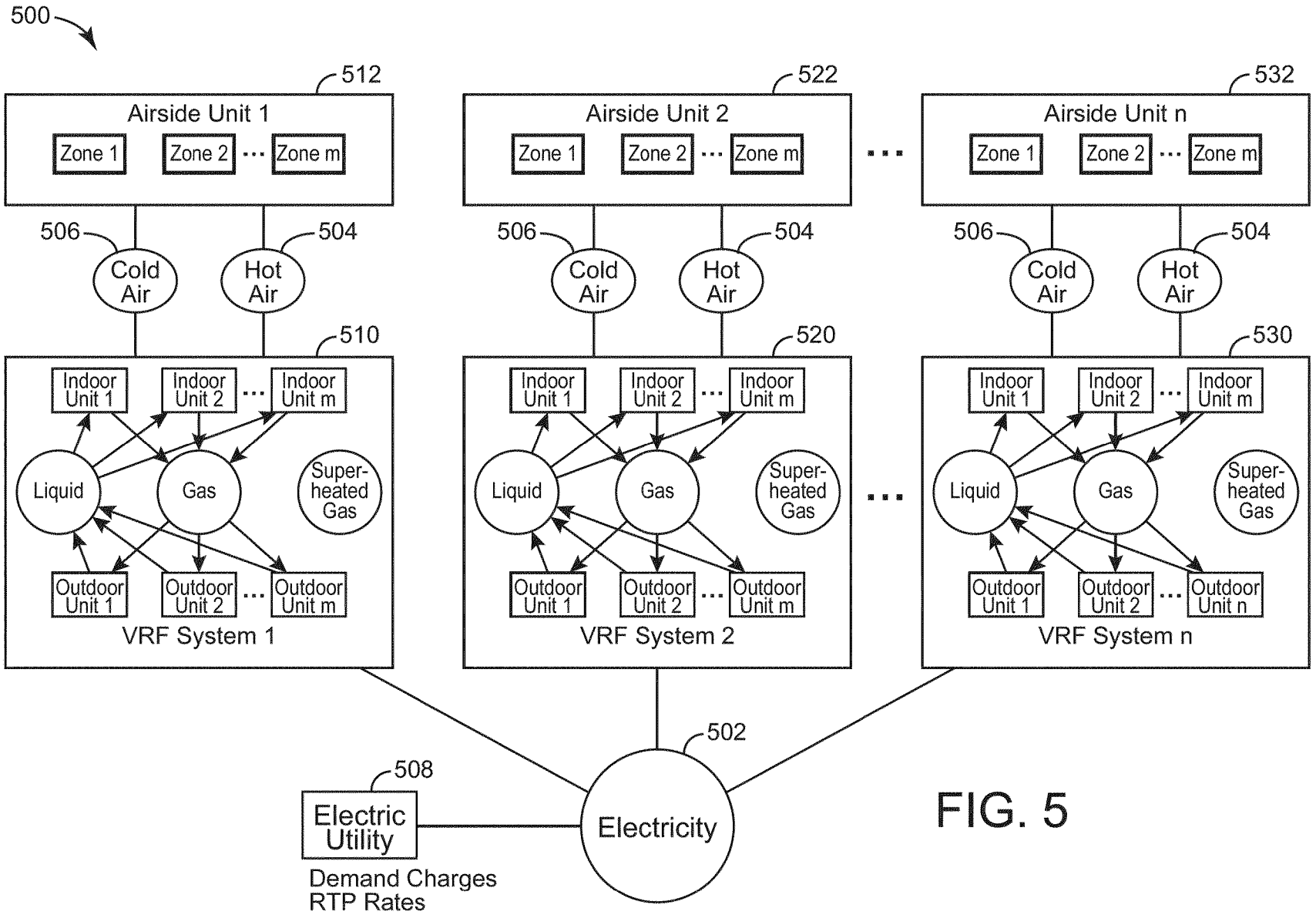
FIG. 5 is a block diagram of a control system for multiple VRF systems, according to some embodiments.

Referring now to FIG. 5, a block diagram of a control system 500 for multiple VRF systems 510, 520, and 530 is shown, according to some embodiments. Each of VRF systems 510-530 can include some or all of the components and/or features of VRF system 100, as described with reference to FIGS. 1A-4B. The optimization framework described above can be extended to a larger system including multiple VRF systems 510-530 by introducing an additional control layer (e.g., a supervisory layer) operating above the high-level and low-level optimization framework. For example, the predictive cost optimization controller can act as a coordinator to coordinate the electricity usage of multiple VRF systems 510-530 over time such that the multiple VRF systems 510-530 achieve an optimal energy cost performance (e.g., minimum total energy cost for the entire set of VRF systems 510-530).

In various embodiments, the cost optimization performed by the predictive cost optimization controller may account for energy cost (e.g., $/kWh of electricity consumed), demand charge (e.g., $/kW of peak power consumption), peak load contribution cost, and/or monetary incentives from participating in incentive-based demand response (IBDR) programs. Several examples of a cost optimization which can be performed by the predictive cost optimization controller are described in detail in U.S. patent application Ser. No. 15/405,236 filed Jan. 12, 2017, U.S. patent application Ser. No. 15/405,234 filed Jan. 12, 2017, U.S. patent application Ser. No. 15/426,962 filed Feb. 7, 2017, and U.S. patent application Ser. No. 15/473,496 filed Mar. 29, 2017.

The entire disclosure of each of these patent applications is incorporated by reference herein.

In the supervisory layer, each of the individual VRF systems 510-530 can be represented as a single asset that converts electricity 502 from an electric utility 508 into either hot air 504 or cold air 506 that is required by the building zones. Hot air 504 and cold air 506 can be delivered to airside units 512, 522, and 532 that provide heating and/or cooling for the building zones served by airside units 512, 522, and 532. Hot air 504 and cold air 506 can be treated as resources produced by VRF systems 510-530, whereas electricity 502 can be treated as a resource consumed by VRF systems 510-530. The relationship between resource production and electricity consumption by each VRF system 510-530 may be defined by a system performance curve for each VRF system 510-530. The system performance curves can be used in the supervisory layer as constraints on the cost optimization performed by the predictive cost optimization controller to ensure that VRF systems 510-530 operate to generate sufficient hot air 504 and cold air 506 for the building zones.

The amount of hot air 504 and cold air 506 to be produced by each of VRF systems 510-530 at each time step of an optimization period can be determined by the predictive cost optimization controller by performing an asset allocation process. Several examples of an asset allocation process which can be performed by the predictive cost optimization controller are described in detail in U.S. patent application Ser. No. 15/405,236, filed Jan. 12, 2017, U.S. patent application Ser. No. 15/405,234, filed Jan. 12, 2017, U.S. patent application Ser. No. 15/426,962, filed Feb. 7, 2017, and U.S. patent application Ser. No. 15/473,496, filed Mar. 29, 2017, the entire disclosures of which are incorporated by reference herein.

Predictive Heating Control

Single Coil System

Figure 6:
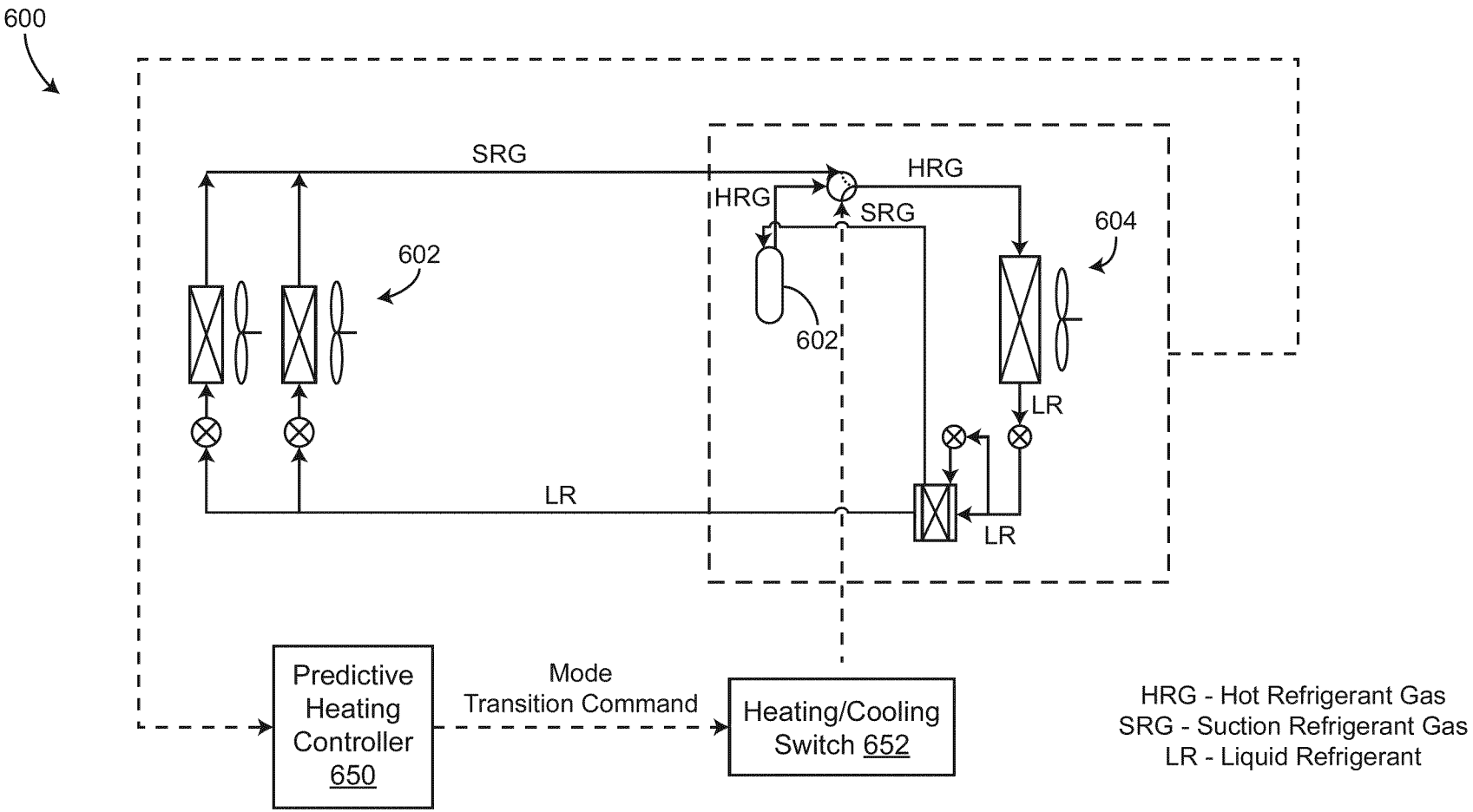
FIG. 6 is a block diagram of a VRF system, according to some embodiments.

Referring now to FIG. 6, a VRF system 600 is shown. VRF system 600 includes a predictive heating controller (PHC) 650 and a heating/cooling switch 652, according to some embodiments. VRF system 600 can be configured to serve a room, a zone, a building space, etc., to provide heating and/or cooling to the room (see FIG. 7). In some embodiments, VRF system 600 is configured to operate in a heating mode and a cooling mode. In some embodiments, when VRF system 600 is in the heating mode, VRF system 600 provides heat to the building space. In some embodiments, when VRF system 600 is in the cooling mode, VRF system 600 provides cooling to the building space that VRF system 600 serves. In some embodiments, VRF system 600 also removes moisture (e.g., performs dehumidification) for the building space when in the cooling mode, in addition to providing cooling to the building space that VRF system 600 serves.

It should be understood that the term "single coil" used throughout refers to any system that uses a single heat exchanger (e.g., a coil) or a single set of functionally linked heat exchangers that can provide both heating and cooling based on operating mode. Single coil systems may have one coil, or multiple coils that are operated in parallel. Any of the single coil systems referred to herein mean that all coils or heat exchangers of the system operate in the same mode at the same time (e.g., all of the coils or heat exchangers operate in a heating mode or a cooling mode).

In some embodiments, PHC 650 is configured to determine when to transition VRF system 600 between the heating mode and the cooling mode (also referred to as the "drying" mode or the "dehumidifying" mode). PHC 650 can determine when to transition VRF system 600 between the heating mode and the cooling mode based on temperature setpoints, sensory temperature values, humidity setpoints (e.g., relative humidity (RH) setpoints), RH sensory values (e.g., current relative humidity values in the building space that VRF system 600 is configured to serve), current occupancy, predicted future occupancy, scheduled future occupancy, etc. In some embodiments, PHC 650 uses one or more scheduling services (e.g., calendars, room reservations, schedules, etc.) for the building space that VRF system 600 is configured to serve (e.g., configured to provide heating and/or cooling). PHC 650 can also receive current occupancy data from an occupancy sensor. In some embodiments, the current occupancy data indicates a number of occupants present in the building space that VRF system 600 is configured to serve. In some embodiments, PHC 650 provides a re-heating command or control signals to heating/cooling switch 652 to transition VRF system 600 between the cooling mode and the heating mode.

VRF system 600 includes one or more indoor heat exchangers 602, a compressor 602, and an outdoor unit 604. In some embodiments, indoor heat exchangers 602 are indoor units 104. In some embodiments, compressor 602 is compressor 112. In some embodiments, outdoor unit 604 is outdoor unit 102. In some embodiments, PHC 650 is configured to operate compressor 602 to provide hot refrigerant gas to outdoor unit 604. Outdoor unit 604 is configured to remove heat from the hot refrigerant gas and output liquid refrigerant. The liquid refrigerant can be provided to indoor heat exchangers 602. Indoor heat exchangers 602 can provide cooling and/or heating to a building zone or a building room that VRF system 600 serves. Indoor heat exchangers 602 receive the liquid refrigerant, draw heat from the building zone or the building room and output suction refrigerant gas.

It should be noted that while the present disclosure shows PHC 650 operating a VRF system, PHC 650 can also be configured to operate any single coil system, such as a roof top unit, an air handling unit, etc.

Figure 7:
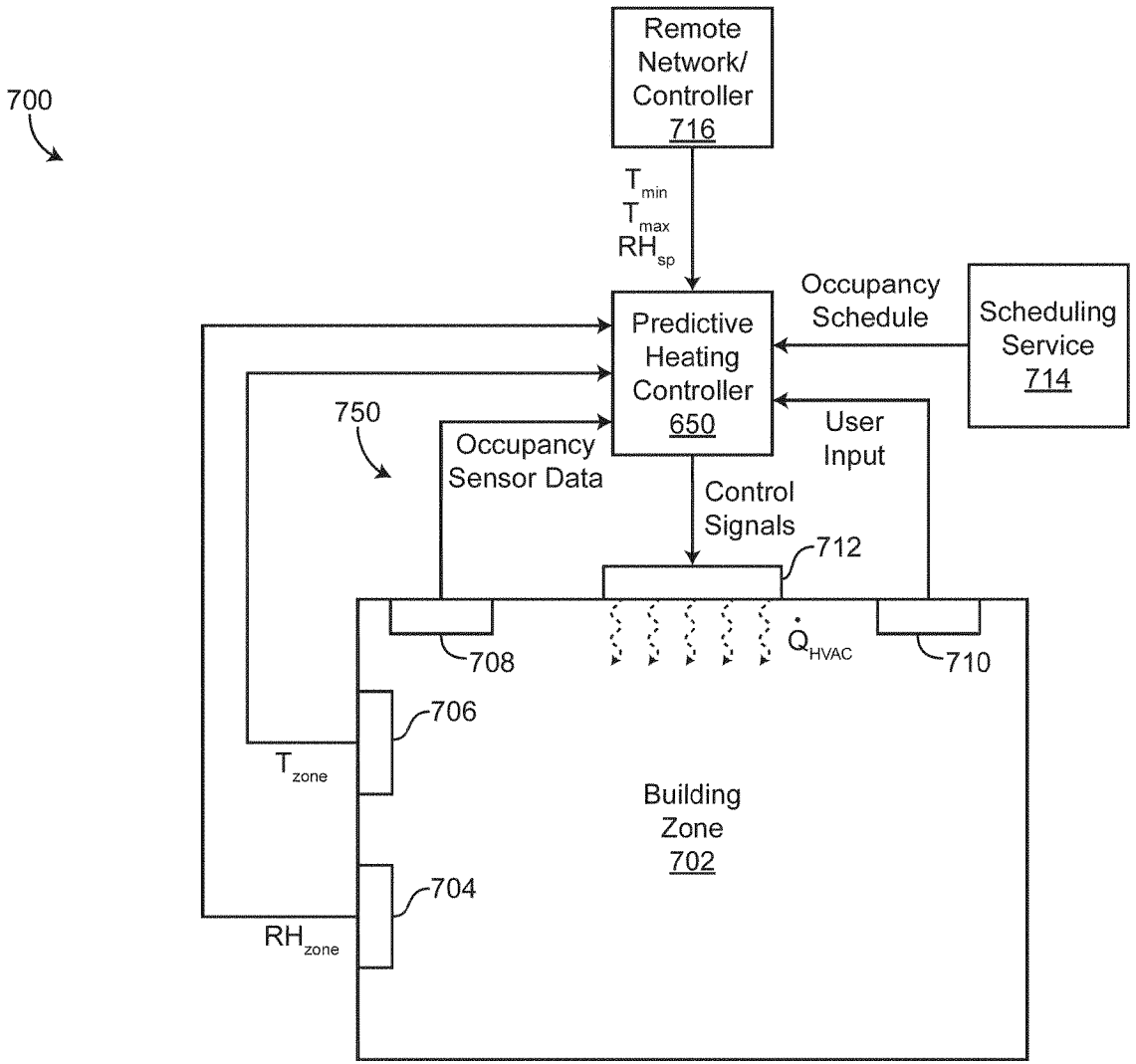
FIG. 7 is a block diagram of a predictive heating system including a predictive heating controller, according to some embodiments.

Referring now to FIG. 7, a block diagram of a predictive heating system 700 is shown. Predictive heating system 700 includes a VRF system 750, according to some embodiments. In some embodiments, VRF system 750 is or includes any of the devices of VRF system 600. In some embodiments, VRF system 750 is or includes any of the devices of VRF system 100. In some embodiments, VRF system 750 is a single-coil system. For example, VRF system 750 can be any system that is configured to operate in a heating mode and a cooling/dehumidification mode, but not both simultaneously. In some embodiments, the single-coil can be operated to heat or cool building zone 702 that VRF system 750 is configured to serve. VRF system 750 is configured to serve building zone 702 by providing heating or cooling to building zone 702 via building equipment 712, according to some embodiments. Building equipment 712 is configured to provide heating or cooling to building zone 702, shown as $\dot{Q}_{HVAC}$. Building equipment 712 can be or include any of the devices of VRF system 100, VRF system 600, etc., that can be operated to affect a temperature in building zone 702. For example, building equipment 712 can be or include one or more indoor units 104, one or more outdoor units 102, etc.

Referring still to FIG. 7, predictive heating system 700 includes a temperature sensor 706, a humidity sensor 704, and an occupancy sensor 708. Predictive heating system 700 can also include a user interface 710 (e.g., a thermostat, a personal computer device such as a smartphone, a smart home/building management device). In some embodiments, predictive heating system 700 includes a thermostat that includes temperature sensor 706, humidity sensor 704, and occupancy sensor 708. In some embodiments, the thermostat includes user interface 710. User interface 710 is configured to receive a user input from an occupant of building zone 702 (or a remote user such as an administrator, an occupant of another building zone, etc.) and provide the user input to PHC 650, according to some embodiments.

PHC 650 is configured to receive one or more temperature measurements from temperature sensor 706, according to some embodiments. In some embodiments, temperature sensor 706 is communicably connected with PHC 650 and provides the one or more temperature measurements, $T_{zone}$ to PHC 650. Likewise, humidity sensor 704 is configured to measure relative humidity, $RH_{zone}$, in building zone 702 and provide the relative humidity values, $RH_{zone}$, to PHC 650, according to some embodiments.

In some embodiments, occupancy sensor 708 is or includes any of a heat sensor, an infrared sensor, a camera, a motion detector, a proximity sensor, etc., or any other sensor that can be configured to monitor the presence of occupants within building zone 702. In some embodiments, occupancy sensor 708 provides PHC 650 with occupancy sensor data. In some embodiments, PHC 650 uses the occupancy sensor data to determine whether or not occupants are currently present in building zone 702 (e.g., to determine a binary value indicating whether one or more occupants are present in building zone 702). In some embodiments, PHC 650 uses the occupancy sensor data to determine/estimate a number of occupants within building zone 702 at a current time.

In some embodiments, predictive heating system 700 includes a scheduling service 714, and a remote network/controller 716. In some embodiments, PHC 650 is configured to receive occupancy schedules of building zone 702 from scheduling service 714. Scheduling service 714 can be any device, controller, system, network, server, etc., configured to store and provide expected occupancy data to PHC 650. In some embodiments, scheduling service 714 is a database that can be updated by a building administrator, building occupants, etc., or another network to include occupancy schedules. In some embodiments, scheduling service 714 includes a calendar that includes times that building zone 702 is expected to be occupied. In some embodiments, scheduling service 714 also stores and provides an expected number of occupants at various times when building zone 702 is scheduled to be occupied to PHC 650.

In some embodiments, scheduling service 714 provides PHC 650 with historic and/or future occupancy schedules of building zone 702. In some embodiments, for example, PHC 650 can retrieve historical calendars from scheduling service 714 regarding occupancy of building zone 702. Likewise, scheduling service 714 can provide PHC 650 with times in the future that building zone 702 is scheduled to be occupied as well as a number of occupants that are expected to be in building zone 702 at the times in the future.

In some embodiments, scheduling service 714 is or includes building calendars, room reservation schedules, meeting schedules, work schedules, personal calendars of various occupants of building zone 702, etc. For example, PHC 650 can receive occupancy schedules from a personal device (e.g., a smart phone, a computer, etc.). In some embodiments, scheduling service 714 is or includes a network or a building administrator provided calendar. In some embodiments, an occupant of building zone 702 can allow PHC 650 and/or scheduling service 714 to access their personal calendar so that PHC 650 can determine when building zone 702 will be occupied. As the occupant adds/removes events to their personal calendar, scheduling service 714 and/or PHC 650 can determine if the added/removed events indicate that the occupant will be present in building zone 702 during the event. For example, if an occupant adds an event "Meeting in North Conference Room" to their calendar, and building zone 702 is the North Conference Room, scheduling service 714 and/or PHC 650 can determine that the occupant will be present in building zone 702 at the time of the event. In another example, if an occupant removes the event "Meeting in North Conference Room" to their calendar, scheduling service 714 and/or PHC 650 may determine that the occupant will not be present in building zone 702 at the time of the event. Likewise, if an occupant adds an event such as "Out of Office" or "Picking up Collin from range," PHC 650 and/or scheduling service 714 may determine that the occupant will not be present in building zone 702 at the time of the event. In some embodiments, scheduled events include a time, date, location, and duration of the scheduled event. In some embodiments, scheduling service 714 and/or PHC 650 can use the location of the scheduled event to determine if the occupant will be present in building zone 702 during the scheduled event.

In some embodiments, occupants of building zone 702 or of the building of building zone 702 can report times at which they will be present in building zone 702. For example, occupants may report times at which they will occupy building zone 702 via user interface 710, a thermostat of building zone 702, a personal device (e.g., through an app on a smart phone), etc. PHC 650 and/or scheduling service 714 can use the reported times at which occupants are scheduled to be in building zone 702 to dehumidify (e.g., dry, cool, etc.) building zone 702 and pre-heat building zone 702 before the reported times or scheduled events in building zone 702.

In some embodiments, remote network/controller 716 is configured to provide PHC 650 with minimum and maximum allowable temperatures of building zone 702 (i.e., $T_{min}$ and $T_{max}$) as well as a relative humidity setpoint (i.e., $RH_{sp}$). In some embodiments, PHC 650 uses the minimum and maximum allowable temperatures of building zone 702, as well as the relative humidity setpoint to determine when to preheat or precool (e.g., dehumidify) building zone 702 before building zone 702 is occupied. In some embodiments, PHC 650 is configured to use the minimum and maximum allowable temperatures of building zone 702 as well as the relative humidity setpoint to operate building equipment 712 while occupants are present in building zone 702. In some embodiments, PHC 650 receives the minimum and maximum allowable temperatures of building zone 702 from user interface 710 (or from a thermostat of building zone 702). For example, an occupant of building zone 702 can set a minimum desired and maximum desired temperature of building zone 702. In some embodiments, PHC 650 uses the minimum and maximum allowable/desired temperatures of building zone 702 to maintain the temperature of building zone 702, $T_{zone}$, within a range defined by $T_{min}$ and $T_{max}$ while occupants are present in building zone 702.

PHC 650 is configured to use any of the input information to determine when to transition building equipment 712 between the cooling mode and the heating mode. In some embodiments, PHC 650 uses the occupancy schedule to determine when to heat building zone 702 (by operating building equipment 712 in the heating mode) before occupants are scheduled to be present in building zone 702. In some embodiments, when occupants are not present in building zone 702, PHC 650 operates building equipment 712 in the cooling mode to dehumidify building zone 702 before building zone 702 is occupied. In some embodiments, at some predetermined time before building zone 702 is scheduled to be occupied, PHC 650 operates building equipment 712 to pre-heat building zone 702 so that building zone 702 is within $T_{max}$ and $T_{min}$ (e.g., so that building zone 702 is comfortable) before building zone 702 is occupied.

In some embodiments, PHC 650 collects occupancy sensor data from occupancy sensor 708 over time and uses a neural network to predict when building zone 702 will be occupied. For example, PHC 650 can identify times of day, days of the week, days of the year, etc., that building zone 702 will likely be occupied based on historical occupancy sensor data received from occupancy sensor 708. In some embodiments, PHC 650 can use the occupancy sensor data to determine when building zone 702 will likely be occupied even if the occupancy is not provided by scheduling service 714. For example, PHC 650 can use the occupancy sensor data to determine that building zone 702 is typically occupied at 2 PM on Tuesdays, even if building zone 702 is not scheduled to be occupied at 2 PM on Tuesdays. In this way, PHC 650 can predict occupancy, dehumidify, and then pre-heat building zone 702 even for unscheduled occupancy of building zone 702.

In some embodiments, PHC 650 uses present and/or historical occupancy sensor data received/collected from occupancy sensor 708 to supplement the occupancy schedule received from scheduling service 714. For example, PHC 650 can use both the historical occupancy sensor data and predictions in combination with the occupancy schedule to determine a likelihood that building zone 702 will be occupied at a time in the future. In some embodiments, PHC 650 uses historical occupancy sensor data to determine the likelihood that building zone 702 will be occupied at a time in the future if building zone 702 is not scheduled to be occupied at that time in the future (e.g., if building zone 702 is not reserved, if a meeting is not scheduled for building zone 702 at that time in the future, etc.).

PHC 650 can identify times in the future at which building zone 702 will be occupied and prepare building zone 702 for the occupancy. For example, if building zone 702 is scheduled to be occupied at a future time $t_{10}$, PHC 650 can prepare building zone 702 for the occupancy from a current time $t_0$ to the future time $t_{10}$. In some embodiments, PHC 650 operates building equipment 712 to affect one or more environmental conditions of building zone 702 from the current time to the future time at which building zone 702 will be occupied. In some embodiments, PHC 650 operates building equipment 712 in the cooling mode for a first time duration before the time at which building zone 702 will be occupied to achieve a desired relative humidity (e.g., to drive $RH_{zone}$ towards $RH_{sp}$) and then in the heating mode of operation for a second time duration before the time at which building zone 702 will be occupied to achieve a desired temperature (e.g., to drive $T_{zone}$ to a value between $T_{min}$ and $T_{max}$). For example, PHC 650 may operate building equipment 712 in the cooling mode from time $t_0$ (the present time) to time $t_5$ to drive $RH_{zone}$ of building zone 702 towards $RH_{sp}$ before time $t_{10}$ at which building zone 702 will be occupied. PHC 650 can then operate building equipment 712 in the heating mode from $t_5$ to $t_{10}$ such that the temperature $T_{zone}$ in building zone 702 is within the minimum and maximum allowable temperatures (i.e., $T_{min}$ and $T_{max}$) before or at the time $t_{10}$ when building zone 702 is scheduled to be occupied. In this way, PHC 650 can operate building equipment 712 so that both the relative humidity and the temperature of building zone 702 are comfortable before building zone 702 is occupied.

Predictive Heating Controller

Figure 8:
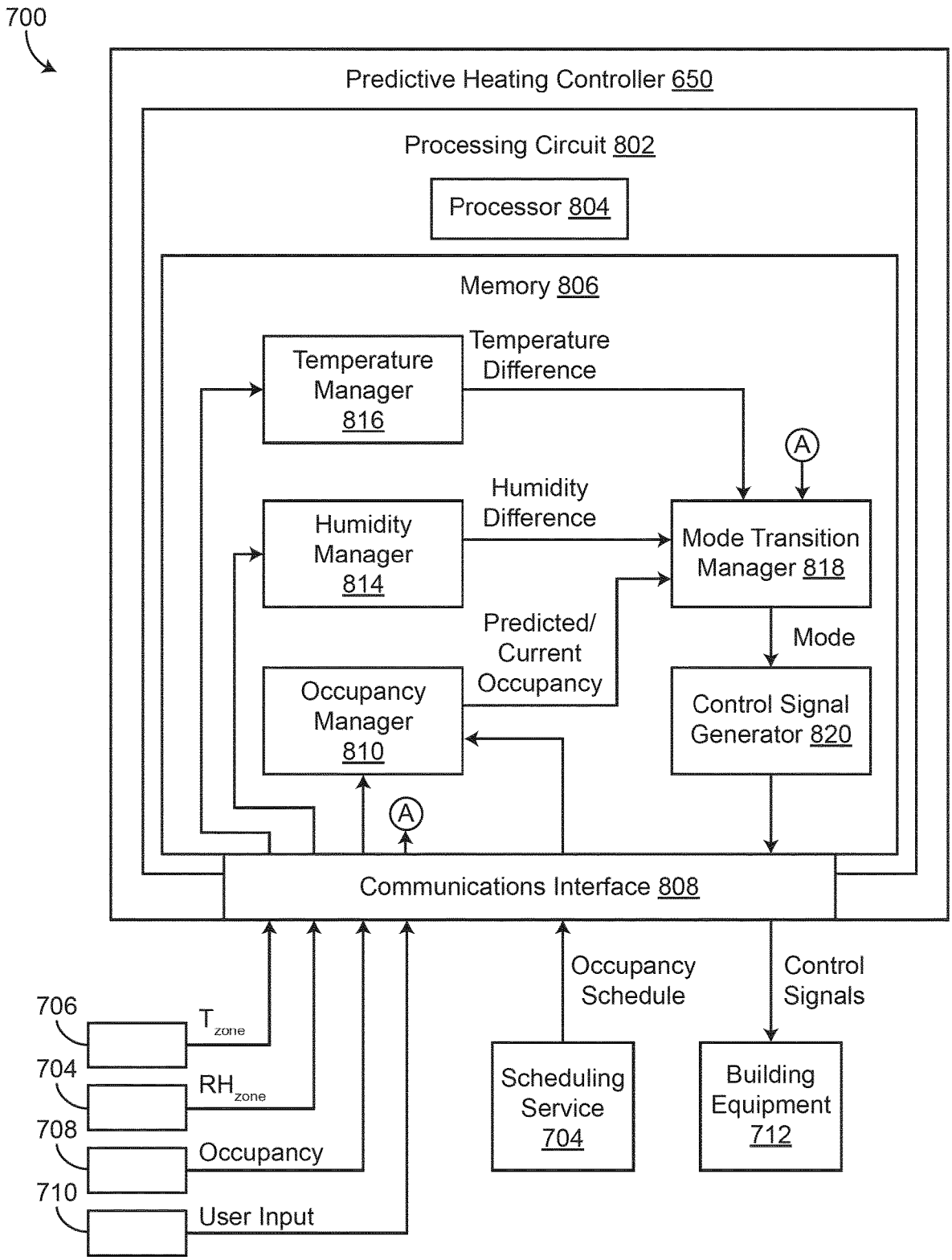
FIG. 8 is a block diagram of the predictive heating system of FIG. 7, showing the predictive heating controller in greater detail, according to some embodiments.

Referring now to FIG. 8, a portion of predictive heating system 700 is shown in greater detail. PHC 650 is shown receiving zone temperature $T_{zone}$ from temperature sensor 706, relative humidity $RH_{zone}$ from humidity sensor 704, occupancy data from occupancy sensor 708, and a user input from user interface 710. PHC 650 also receives occupancy schedules from scheduling service 704, according to some embodiments. PHC 650 is also configured to receive the minimum and maximum allowable temperatures, (i.e., $T_{min}$ and $T_{max}$) from remote network/controller 716 (not shown in FIG. 8) or from user interface 710, according to some embodiments. In some embodiments, PHC 650 is configured to receive a temperature setpoint (e.g., a desired temperature setpoint, $T_{sp}$) from user interface 710 and/or from remote network/controller 716.

In some embodiments, PHC 650 is integrated within a single computer (e.g., one server, one housing, etc.). In various other exemplary embodiments, PHC 650 can be distributed across multiple servers or computers (e.g., that can exist in distributed locations). In another exemplary embodiment, PHC 650 may integrated with a smart building manager that manages multiple building systems and/or combined with a building management system.

PHC 650 is shown to include a communications interface 808 and a processing circuit 802. Communications interface 808 may include wired or wireless interfaces (e.g., jacks, antennas, transmitters, receivers, transceivers, wire terminals, etc.) for conducting data communications with various systems, devices, or networks. For example, communications interface 808 may include an Ethernet card and port for sending and receiving data via an Ethernet-based communications network and/or a WiFi transceiver for communicating via a wireless communications network. Communications interface 808 may be configured to communicate via local area networks or wide area networks (e.g., the Internet, a building WAN, etc.) and may use a variety of communications protocols (e.g., BACnet, IP, LON, etc.).

Communications interface 808 may be a network interface configured to facilitate electronic data communications between PHC 650 and various external systems or devices (e.g., temperature sensor 706, humidity sensor 704, occupancy sensor 708, user interface 710, a thermostat of building zone 702, scheduling service 704, building equipment 712, a VRF system such as VRF system 100, VRF system 600, remote network/controller 716, etc.). For example, PHC 650 may receive information from a building management system or from sensors (e.g., temperature sensor 706, humidity sensor 704, etc.) indicating one or more measured states of the controlled building (e.g., temperature, humidity, electric loads, etc.) and one or more states of a VRF system (e.g., VRF system 100, VRF system 600, etc.). Communications interface 808 may receive inputs from temperature sensor 706, humidity sensor 704, occupancy sensor 708, user interface 710, scheduling service 704, and may provide operating parameters (e.g., on/off decisions, setpoints, control signals etc.) to building equipment 712 or any unit/ device of a VRF or HVAC system (e.g., VRF system 100, VRF system 600, etc.). The operating parameters may cause building equipment 712 to activate, deactivate, or adjust a setpoint for various devices thereof.

Still referring to FIG. 8, processing circuit 802 is shown to include a processor 804 and memory 806. Processor 804 may be a general purpose or specific purpose processor, an application specific integrated circuit (ASIC), one or more field programmable gate arrays (FPGAs), a group of processing components, or other suitable processing components. Processor 804 may be configured to execute computer code or instructions stored in memory 806 or received from other computer readable media (e.g., CDROM, network storage, a remote server, etc.).

Memory 806 may include one or more devices (e.g., memory units, memory devices, storage devices, etc.) for storing data and/or computer code for completing and/or facilitating the various processes described in the present disclosure. Memory 806 may include random access memory (RAM), read-only memory (ROM), hard drive storage, temporary storage, non-volatile memory, flash memory, optical memory, or any other suitable memory for storing software objects and/or computer instructions. Memory 806 may include database components, object code components, script components, or any other type of information structure for supporting the various activities and information structures described in the present disclosure. Memory 806 may be communicably connected to processor 804 via processing circuit 802 and may include computer code for executing (e.g., by processor 804) one or more processes described herein.

Memory 806 is shown to include an occupancy manager 810, a humidity manager 814, and a temperature manager 816. Occupancy manager 810 is configured to receive occupancy sensor information/data from occupancy sensor 708, according to some embodiments. Occupancy manager 810 is also configured to receive scheduled occupancy of the building zone/space associated with PHC 650 (e.g., the building zone/space that PHC 650 is configured to operate building equipment 712 to affect an environmental condition of), according to some embodiments. In some embodiments, occupancy manager 810 is configured to collect occupancy sensor data over a time period and generate a model based on the collected occupancy sensor data. In some embodiments, occupancy manager 810 is configured to predict occupancy of building zone 702 at a future time period based on any of the received occupancy schedule, current occupancy sensor data, and outputs of the generated model. Occupancy manager 810 predicts occupancy of building zone 702 at a future time and provides mode transition manager 818 with the predicted occupancy of building zone 702 at the future time. In some embodiments, occupancy manager 810 predicts a likelihood that building zone 702 will be occupied at a future time and provides mode transition manager 818 with the predicted occupancy likelihood.

In some embodiments, humidity manager 814 is configured to receive the measured/sensed relative humidity $RH_{zone}$ of building zone 702 from humidity sensor 704 as well as a humidity setpoint $RH_{sp}$. In some embodiments, the humidity setpoint $RH_{sp}$ is received from user interface 710. In some embodiments, the humidity setpoint $RH_{sp}$ is received from remote network/controller 716. In some embodiments, the humidity setpoint $RH_{sp}$ is pre-programmed into PHC 650.

In some embodiments, humidity manager 814 is configured to calculate a deviation of the measured relative humidity $RH_{zone}$ from the relative humidity setpoint $RH_{sp}$. In some embodiments, humidity manager 814 calculates a difference between the measured relative humidity $RH_{zone}$ and the relative humidity setpoint, $RH_{sp}$. In some embodiments, humidity manager 814 provides the difference and/or the deviation to mode transition manager 818.

Humidity manager 814 can receive, collect, and track the relative humidity $RH_{zone}$ over a time duration. Humidity manager 814 can determine if the measured relative humidity $RH_{zone}$ exceeds the relative humidity setpoint $RH_{sp}$ and provide mode transition manager 818 with an indication regarding how comfortable the current relative humidity of building zone 702 is, relative to the relative humidity setpoint $RH_{sp}$.

Temperature manager 816 is configured to operate/function similarly to humidity manager 814 but with regards to temperature of building zone 702, $T_{zone}$. In some embodiments, temperature manager 816 receives one or more of a temperature setpoint $T_{sp}$, the minimum allowable temperature $T_{min}$, and the maximum allowable temperature $T_{max}$ from any of user interface 710, remote network/controller 716, etc. In some embodiments, one or more or all of the temperature setpoint $T_{sp}$, the minimum allowable temperature $T_{min}$, and the maximum allowable temperature $T_{max}$ are stored in memory 806 of PHC 650. Temperature manager 816 can determine if the temperature $T_{zone}$ of building zone 702 exceeds $T_{max}$, is less than $T_{min}$, etc. In some embodiments, temperature manager 816 notifies mode transition manager 818 if the temperature within building zone 702 is outside of a range defined by the minimum allowable temperature $T_{min}$ and the maximum allowable temperature $T_{max}$. In some embodiments, temperature manager 816 is configured to determine a difference between any of $T_{zone}$ and $T_{min}$, $T_{max}$, and $T_{sp}$. In some embodiments, temperature manager 816 provides the determined temperature difference to mode transition manager 818.

Mode transition manager 818 is configured to receive any of the predicted occupancy, the current occupancy, the humidity difference, the temperature difference, and the user input to determine when to transition between various modes of operation of building equipment 712. For example, mode transition manager 818 can determine when building equipment 712 should transition between the cooling mode, the heating mode, a standby mode, an off mode, an enabled mode, etc. In some embodiments, mode transition manager 818 provides control signal generator 820 with a selected one of the various modes of operation of building equipment 712. In some embodiments, control signal generator 820 is configured to receive the selected mode from mode transition manager 818 and operate building equipment 712 according to the selected mode. In some embodiments, control signal generator 820 continues operating building equipment 820 in the selected mode until mode transition manager 818 provides control signal generator 820 with another selected mode. Control signal generator 820 can operate building equipment 712 according to the selected mode of operation received from mode transition manager 818 by generating mode-specific control signals and providing the mode-specific control signals to building equipment 712 (or by providing control signals to heating/cooling switch 652).

For example, mode transition manager 818 can determine when to transition building equipment 712 into a cooling mode in order to dehumidify building zone 702. Mode transition manager 818 can provide control signal generator 820 with a command to transition building equipment 712 into the cooling mode. Control signal generator 820 can receive the command to transition building equipment 712 into the cooling mode and generates control signals for building equipment 712 to operate building equipment 712 in the cooling mode. Control signal generator 820 can continue to operate building equipment 712 in the cooling mode by generating and providing control signals to building equipment 712 until control signal generator 820 receives a command to transition building equipment 712 into a different mode of operation (e.g., a heating mode of operation, a standby mode of operation, etc.).

In some embodiments, mode transition manager 818 receives a user input from user interface 710. In some embodiments, the user input includes a command to activate or deactivate pre-heating functionality. The occupant/user can input the command to activate or deactivate pre-heating functionality by flipping a switch, sending a command on a mobile application of a smart phone, turning a dial, etc. In some embodiments, if mode transition manager 818 has not received a command from user interface 710 to enable the re-heat functionality, mode transition manager 818 does not provide control signal generator 820 with commands to pre-cool and pre-heat building zone 702. Likewise, if mode transition manager 818 receives a command to enable the pre-heat functionality, mode transition manager 818 can provide control signal generator 820 with mode selections prior to occupancy of building zone 702 to generate control signals for building equipment 712 to pre-heat and pre-cool building zone 702.

Occupancy Prediction

Figure 9:
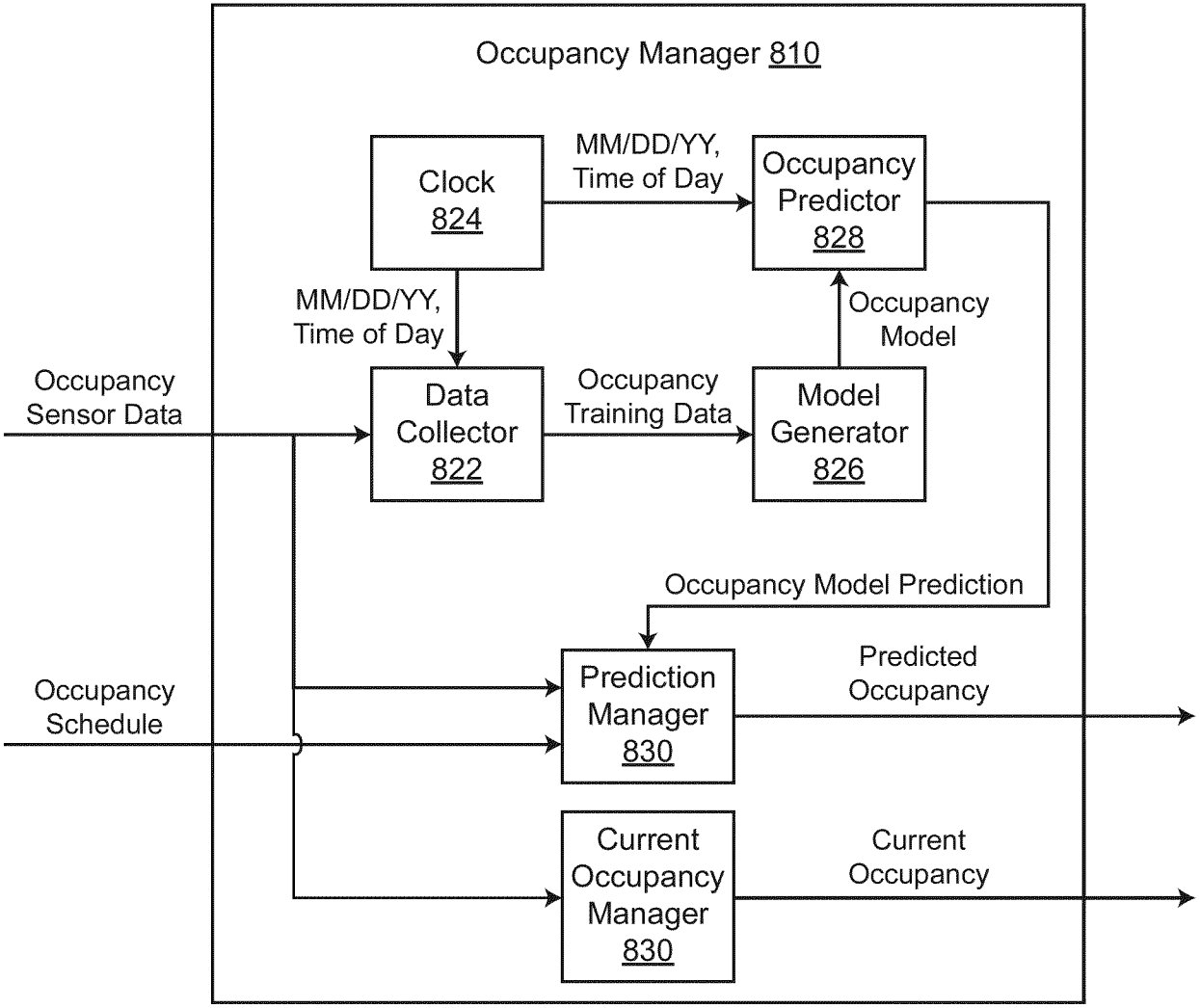
FIG. 9 is a block diagram of a portion of the predictive heating controller of FIG. 7, configured to predict occupancy of a building zone at a future time, according to some embodiments.

Referring now to FIG. 9, occupancy manager 810 is shown in greater detail. Occupancy manager 810 can perform occupancy prediction using any of the techniques, systems, or methods described in U.S. patent application Ser. No. 15/260,294, filed Sep. 8, 2016, U.S. patent application Ser. No. 15/260,295, filed Sep. 8, 2016, and U.S. patent application Ser. No. 15/260,293, filed Sep. 8, 2016, the entire disclosures of which are incorporated by reference herein. Occupancy manager 810 includes a clock 824, a data collector 822, a model generator 826, and an occupancy predictor 828, according to some embodiments. In some embodiments, occupancy manager 810 is configured to receive and/or collect occupancy sensor data from occupancy sensor 708 over a time period. In some embodiments, data collector 822 is configured to aggregate, sort, compile, etc., any of the collected occupancy sensor data over the time period. In some embodiments, data collector 822 receives a date (e.g., in month, day, year format), and a time of day (e.g., hours and minutes of the day) from clock 824. In some embodiments, data collector 822 receives occupancy sensor data and current date and time values from clock 824 and compiles data points. In some embodiments, each of the data points include occupancy sensor data received from occupancy sensor 708 and a time and date at which the occupancy sensor data was measured (e.g., corresponding date and time of day received from clock 824).

In some embodiments, data collector 822 provides the compiled data points to model generator 826 as training data. In some embodiments, model generator 826 receives the training data and generates an occupancy model based on the training data. In some embodiments, the generated occupancy model predicts occupancy (e.g., occupancy sensor data) as a function of date and time of day. In some embodiments, model generator 826 is configured to identify a day type of the received data points. For example, model generator 826 can differentiate between weekdays and weekends. In some embodiments, model generator 826 is configured to generate a model for each day of the week, or for the various day types. In some embodiments, the occupancy model generated by model generator 826 predicts the occupancy of building zone 702 (e.g., occupancy sensor data, number of occupants, whether or not occupants will be present, etc.) as a function of date, day type (e.g., weekend or weekday), and time of day. For example, the occupancy model generated by model generator 826 may have the form $occ_{zone}=f_{model}(Day_{year}, Day_{time}, Day_{type})$, where $Day_{year}$ is a day of the year, $Day_{time}$, is a time of day, $Day_{type}$ is a day type (e.g., weekday or weekend), $occ_{zone}$ is an indication of occupancy of building zone 702 (e.g., number of expected occupants, a binary value indicating whether or not building zone 702 will be occupied, a likelihood of whether or not building zone 702 will be occupied, predicted occupancy sensor data at the future time and date, etc.), and $f_{model}$ is the occupancy model that relates $Day_{year}$, $Day_{time}$, and $Day_{type}$ to $occ_{zone}$.

Model generator 826 can be configured to generate the model (e.g., $f_{model}$) to predict the occupancy of building zone 702 using any neural network, machine learning algorithm, regression technique, or model generation technique. For example, model generator 826 can use any of a feedforward neural network, a radial basis function neural network, a recurrent neural network, a Bayesian neural network, a convolutional neural network, a modular neural network, etc., or any other neural network or machine learning algorithm. In some embodiments, model generator 826 is configured to perform a single or multi-variable regression to generate the occupancy model.

Model generator 826 can generate the occupancy model based on the training data received from data collector 822. In some embodiments, model generator 826 provides the generated occupancy model to occupancy predictor 828 in response to generating the occupancy model. Occupancy predictor 828 is configured to use the generated occupancy model to predict occupancy of building zone 702, according to some embodiments. In some embodiments, occupancy predictor 828 is configured to receive a current date and/or time from clock 824 (as well as a current day type) and input the current date and/or time received from clock 824 to the generated occupancy model. Occupancy predictor 828 can use the generated occupancy model to predict the likelihood of building zone 702 being occupied at any time in the future. In some embodiments, occupancy predictor 828 uses the generated occupancy model to determine the likelihood that building zone 702 will be occupied at any point in the future over a future time period. In some embodiments, occupancy predictor 828 outputs the occupancy model prediction to prediction manager 820.

Prediction manager 830 is configured to receive the occupancy model prediction from occupancy predictor 828 as well as the occupancy schedule from scheduling service 704, according to some embodiments. In some embodiments, prediction manager 830 also receives current occupancy sensor data from occupancy sensor 708. In some embodiments, prediction manager 830 is configured to use the occupancy schedule in addition to the occupancy model prediction received from occupancy predictor 828 to determine if occupants will be present in building zone 702 at a future time. In some embodiments, prediction manager 830 uses the occupancy schedule as the predicted occupancy if an event/meeting/occupancy is scheduled for building zone 702 at a future time or over a future time period. In some embodiments, if an event/meeting/occupancy is not scheduled for the future time, prediction manager 830 uses the occupancy model prediction as the predicted occupancy for the future time. In this way, prediction manager 830 can provide predicted occupancy to mode transition manager 818 even if an event is not scheduled for the future time.

In some embodiments, occupancy manager 810 includes a current occupancy manager 830. Current occupancy manager 830 is configured to receive the occupancy sensor data as measured/sensed by occupancy sensor 708. In some embodiments, current occupancy manager 830 is configured to analyze the received occupancy sensor data to determine if occupants are currently present in building zone 702. In some embodiments, current occupancy manager 830 uses a relationship (e.g., a function, a probabilistic function, a regression-generated function, an equation, etc.) to determine if occupants are currently present in building zone 702 based on the occupancy sensor data. In some embodiments, current occupancy manager 830 is configured to compare current occupancy sensor data as measured by occupancy sensor 708 to known values of occupancy sensor data when occupants are present in building zone 702. For example, if occupancy sensor 708 is a motion detector, current occupancy manager 830 can be configured to compare the detected motion data (e.g., the occupancy sensor data) to known motion data that is representative of when an occupant is present in building zone 702. Current occupancy manager 830 can determine if an occupant is currently present in building zone 702 based on the occupancy sensor data. In some embodiments, current occupancy manager 830 compares a current voltage value of the occupancy sensor signal (e.g., the signal received from occupancy sensor 708) to a threshold value to determine if occupants are currently present in building zone 702. In some embodiments, if the current voltage value of the occupancy sensor signal exceeds the threshold value, current occupancy manager 830 determines that occupants are currently present in building zone 702.

For example, if occupancy sensor 708 is a motion detector, current occupancy manager 830 can identify rapid changes in the voltage of the occupancy sensor signal and determine that occupants are currently present in building zone 702. In some embodiments, occupancy sensor 708 is or includes a camera, and current occupancy manager 830 is configured to analyze visual images to determine if occupants are present in building zone 702. In some embodiments, occupancy sensor 708 is or includes a sound detector. Current occupancy manager 830 can monitor the sound level (or the frequency) monitored in building zone 702 to determine if occupants are currently present in building zone 702. In some embodiments, current occupancy manager 830 is configured to recognize voices, words, phrases, etc., received from occupancy sensor 708 and determine that occupants are currently present in building zone 702 in response to recognizing voices, words, phrases, etc.

In some embodiments, occupancy sensor 708 is or includes a motion or proximity sensor near an entry of building zone 702 (e.g., near a door, near an access point, etc.). If occupancy sensor 708 is triggered, current occupancy manager 830 can determine that an occupant is currently present in building zone 702 (e.g., has entered building zone 702).

In some embodiments, current occupancy manager 830 is configured to perform any of its respective functionality, processing, identification, analyzing, etc., of the occupancy sensor data received from occupancy sensor 708 before the occupancy sensor data is provided to data collector 822. In some embodiments, current occupancy manager 830 provides data collector 822 with an indication of whether or not occupants are currently present in building zone 702 (or with an indication of how many occupants are currently present in building zone 702). Data collector 822 can use the indication of whether or not occupants are currently present in building zone 702 (or the indication of how many occupants are currently present in building zone 702) to perform any of the functionality described hereinabove. In some embodiments, current occupancy manager 830 is configured to perform its respective functionality, processing, identification, analyzing, etc., on the occupancy model prediction output by occupancy predictor 828. For example, if occupancy predictor 828 is configured to predict values, signals, data, etc., of occupancy sensor 708, current occupancy manager 830 can use the predicted values, signals, data, etc., provided by occupancy predictor 828 to determine whether or not occupants will be present in building zone 702 at the future time (or to determine how many occupants will be present in building zone 702 at the future time). In some embodiments, current occupancy manager 830 provides the determination of whether occupants will be present in building zone 702 at the future time (or the determination of how many occupants will be present in building zone 702 at the future time) to prediction manager 830. In this way, current occupancy manager 830 can be configured to determine occupancy (e.g., to determine a binary value of whether or not occupants will be present, or to determine how many occupants will be present) based on occupancy sensor data received from occupancy sensor 708.

In some embodiments, occupancy sensor 708 includes functionality to determine if an occupant is present. For example, occupancy sensor 708 can be configured to perform any of the functionality of current occupancy manager 830 before the occupancy sensor data is provided to PHC 650. In this way, the occupancy sensor data may already indicate whether or not occupants are present or may indicate a number of occupants currently present in building zone 702 and can be used by occupancy manager 810.

Dehumidifying and Pre-Heating Operations

Figure 13:
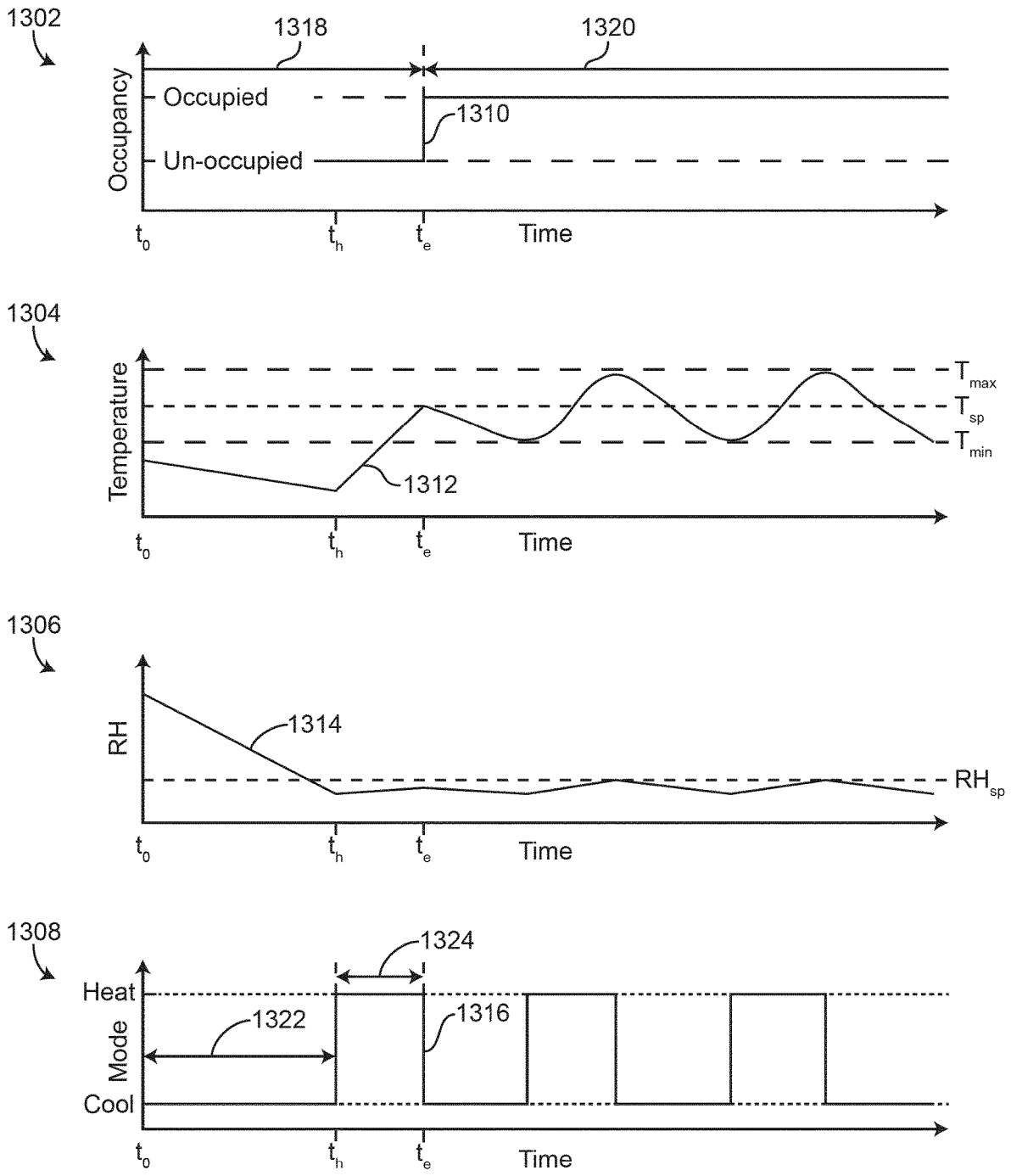
FIG. 13 is a drawing of various graphs of occupancy, temperature, relative humidity, and equipment operational mode over time, according to some embodiments.

Referring to FIG. 8 and FIG. 13, the operation of mode transition manager 808 is shown in greater detail. FIG. 13 includes graph 1302, graph 1304, graph 1306, and graph 1308, according to some embodiments. Graph 1302 illustrates occupancy (the Y-axis) of a building zone or room (e.g., building zone 702) with respect to time (the X-axis), according to some embodiments. Series 1310 of graph 1302 demonstrates the presence of occupants in building zone 702. As shown in graph 1302, building zone 702 is unoccupied from time $t=t_0$ to time $t=t_e$. After time $t_e$, building zone 702 is shown to be occupied. Time $t_e$ (the time at which building zone 702 becomes occupied) can be determined/predicted/estimated by occupancy manager 810 using any of the techniques, methods, functionality, etc., described in greater detail above.

The time over which building zone 702 is occupied is shown as time period 1320. Time period 1320 is defined as the time duration between when building zone 702 starts being occupied (e.g., at $t=t_e$) and when building zone 702 stops being occupied (e.g., some point in the future, not shown in graph 1302). Likewise, the time over which building zone 702 is unoccupied is shown as time period 1318. Time period 1318 is defined as the time duration between when building zone 702 starts being occupied (e.g., at time $t=t_e$) and an end time at which building zone 702 was previously occupied (e.g., at a time before $t=t_0$, not shown in graph 1302).

It should be noted that while graph 1302 shows occupancy as a binary value (e.g., either occupied or un-occupied), the techniques, methods, functionality, etc., described herein can also apply if occupancy is treated as a scalar quantity (e.g., a number of occupants present in building zone 702 at a given point in time).

Graph 1304 illustrates temperature (the Y-axis) with respect to time (the X-axis), according to some embodiments. In some embodiments, series 1312 illustrates room/zone temperature (e.g., zone temperature $T_{zone}$) with respect to time.

Graph 1306 illustrates relative humidity (the Y-axis) with respect to time (the X-axis), according to some embodiments. In some embodiments, series 1314 illustrates relative humidity in building zone 702 (e.g., $RH_{zone}$) with respect to time.

Graph 1308 illustrates the mode of operation of building equipment 712 (the Y-axis) with respect to time (the X-axis), according to some embodiments. In some embodiments, series 1316 of graph 1308 represents the current mode of operation of building equipment 712 with respect to time.

Graph 1304 illustrates the setpoint temperature $T_{sp}$, the maximum allowable temperature $T_{max}$, and the minimum allowable temperature $T_{min}$. In some embodiments, the temperature of building zone 702 (e.g., the Y-axis value of series 1312) is maintained between the maximum allowable temperature $T_{max}$ and the minimum allowable temperature $T_{min}$ while building zone 702 is occupied (e.g., during time period 1320). In some embodiments, when building zone 702 is un-occupied (e.g., during time period 1318), the temperature of building zone 702 (e.g., $T_{zone}$) may be greater than the maximum allowable temperature, or less than the minimum allowable temperature (as shown by the Y-axis value of series 1312 being less than $T_{min}$ between time $t_0$ and time $t_e$).

In some embodiments, mode transition manager 818 causes control signal generator 820 to operate building equipment 712 in the cooling mode and then the heating mode over a time period before building zone 702 is occupied. In some embodiments, mode transition manager 818 causes control signal generator 820 to operate building equipment 712 in the cooling mode to dehumidify building zone 702 over a dehumidification period 1322, and then causes control signal generator 820 to operate building equipment 712 in the heating mode over heating period 1324. It should be noted that both dehumidification period 1322 and heating period 1324 may entirely (or at least partially) occur before building zone 702 is occupied. Heating period 1324 is defined between a time $t_h$ and the time $t_e$ when building zone 702 becomes occupied. In some embodiments, $t_h$ is defined as a temporally offset time point relative to the time $t_e$ when building zone 702 becomes occupied. For example, the time $t_h$ may be defined as:

$$t_h = t_e - t_{heat,req}$$

where $t_h$ is the time at which heating period 1324 should begin, $t_e$ is the time at which building zone 702 becomes occupied, and $t_{heat,req}$ is the required amount of time to raise the zone temperature $T_{zone}$ from a temperature at time $t_h$ to an acceptable temperature at time $t_e$. Mode transition manager 818 can use the above relationship to determine the time $t_h$ at which heating period 1324 should begin.

In some embodiments, the required amount of time to raise the zone temperature $T_{zone}$ is a function of the temperature of building zone 702 at time $t_h$ and a desired or target temperature at time $t_e$. The desired/target temperature can be $T_{sp}$, $T_{min}$, $T_{max}$, or any other temperature value between $T_{min}$ and $T_{max}$. In some embodiments, the desired/target temperature is a value greater than $T_{max}$ and/or a value less than $T_{min}$. In some embodiments, the desired/target temperature at time $t_e$ is determined by mode transition manager 808. In some embodiments, mode transition manager 808 receives an outdoor temperature (or an outdoor weather condition, such as humidity, air quality, etc.) and determines the desired/target temperature at time $t_e$ based on the outdoor temperature (or the outdoor weather condition). For example, during winter time (e.g., if the outdoor temperature is less than a temperature threshold value), the desired/target temperature at time $t_e$ may be $T_{max}$ while during summer time (e.g., if the outdoor temperature is greater than a threshold temperature value) the desired/target temperature at time $t_e$ may be $T_{min}$.

In some embodiments, mode transition manager 818 uses a function to determine $t_{heat,req}$:

$$t_{heat,req} = f(T_{t_h}, T_{target}, p_{equipment}, p_{zone})$$

where $T_{t_h}$ is the temperature of building zone 702 at time $t_h$, $T_{target}$ is the target/desired temperature of building zone 702 at time $t_e$ (i.e., a desired temperature value of building zone 702 when building zone 702 becomes occupied), $p_{equipment}$ is a vector of one or more performance variables of building equipment 712 (e.g., a rate at which building equipment 712 can add heat to building zone 702, a rate at which building equipment 712 can change the temperature of building zone 702, etc.), $p_{zone}$ is a vector of one or more system parameters of building zone 702 (e.g., one or more heat capacitances of building zone 702, system identification parameters that indicate how building zone 702 stores or dissipates heat, system identification parameters that indicate the temperature of building zone 702 with respect to added heat, etc.), and f is a relationship that relates $T_{t_h}$, $T_{target}$, $p_{equipment}$, and $p_{zone}$ to $t_{heat,req}$. Mode transition manager 818 can also determine $t_{heat,req}$ using a difference between $T_{t_h}$ and $T_{target}$. For example, mode transition manager 818 can use the function: $t_{heat,req} = f(\Delta T, p_{equipment}, p_{zone})$ where $\Delta T = T_{target} - T_{t_h}$.

In some embodiments, the time $t_{heat,req}$ is a known value. For example, the time $t_{heat,req}$ can be a predetermined value that has been determined (e.g., based on analysis and/or empirical test results) to be sufficiently long to increase the temperature of building zone 702 to the target/desired temperature $T_{target}$ at time $t_e$. In some embodiments, the time $t_{heat,req}$ includes buffer time so that the temperature $T_{zone}$ of building zone 702 can be driven to the target/desired temperature $T_{target}$ at time $t_e$. For example, the required time $t_{heat,req}$ may be 20 minutes, 15 minutes, 10 minutes, etc., or any other time duration that is sufficiently long to drive the zone temperature $T_{zone}$ of building zone 702 towards the target/desired temperature $T_{target}$.

In some embodiments, mode transition manager 808 is configured to determine what times to transition between the heating mode and the cooling mode using an optimization approach. Mode transition manager 808 can generate and minimize a cost function that accounts for cost of operating building equipment 712, system identification parameters of building zone 702, comfort constraints, subplant models of building equipment 712, etc., to determine when to transition between the heating mode and the cooling mode. Mode transition manager 808 can use any of the techniques, systems, and methods to generate and minimize the cost function to determine when to transition building equipment 712 described U.S. application Ser. No. 15/473,496, filed Mar. 29, 2017, the entire disclosure of which is incorporated herein by reference.

If time between occupancies is not adequately long for building equipment 712 to operate to achieve both the target/desired temperature $T_{target}$ at time $t_e$ and target/desired relative humidity $RH_{target}$ (described in greater detail below) at time $t_e$ PHC 650 can operate building equipment 712 such that at least one of the temperature $T_{zone}$ and $RH_{zone}$ meet or are as close as possible to the target/desired values. In some embodiments, if mode transition manager 808 uses the optimization approach, mode transition manager 808 can determine a penalty cost. The penalty cost can have the form $p_k=w_1T_{error}+w_2RH_{error}$ where $p_k$ is the penalty cost, $T_{error}$ is a predicted temperature error (e.g., an amount that the zone temperature $T_{zone}$ is expected/predicted to be above or below the maximum and minimum allowable temperatures, respectively) $RH_{zone}$ is a predicted relative humidity error (e.g., an amount that the relative humidity $RH_{zone}$ is expected/predicted to be above or below the maximum and minimum allowable relative humidity values, respectively), and $w_1$ and $w_2$ are weights associated with the predicted temperature error and the predicted relative humidity error, respectively. In some embodiments, $w_1$ and $w_2$ are large values such that PHC 650 is discouraged from missing the comfort ranges of the zone temperature $T_{zone}$ and the relative humidity $RH_{zone}$.

The penalty cost can be incorporated into the cost function. Minimizing the cost function results in determining mode transition times that reduce the costs associated with $T_{zone}$ or $RH_{zone}$ being outside their respective ranges such that operational costs are minimized. PHC 650 may determine that the most cost effective solution to drive the zone temperature $T_{zone}$ and the relative humidity $RH_{zone}$ within the acceptable ranges is to rapidly transitioning building equipment 712 between the heating mode and the cooling mode.

In some embodiments, dehumidification period 1322 is defined as a time period $t_{cool,req}$ before heating period 1324. For example, dehumidification period 1322 can be defined as a time period from time $t_d$ to time $t_h$, where $t_d=t_h-t_{cool,req}$ and $t_{cool,req}$ is a required amount of time for building equipment 712 to dehumidify/dry building zone 702. The example shown in FIG. 13 shows the present time, $t_0$, at time $t_d$ (the beginning of dehumidification period 1322).

In some embodiments, mode transition manager 818 is configured to determine the time $t_d$ to begin dehumidification period 1322. For example, mode transition manager 818 can determine the required amount of time $t_{cool,req}$ to dehumidify building zone 702. In some embodiments, mode transition manager 818 uses a predetermined value for the required amount of time $t_{cool,req}$ (e.g., 10 minutes, 15 minutes, 20 minutes, etc.). In this way, mode transition manager 818 can transition building equipment 712 into the cooling mode at some predetermined amount of time before time $t_e$ when building zone 702 will be occupied, and then transition building equipment 712 into the heating mode at some other predetermined amount of time before time $t_e$.

In some embodiments, the required amount of time $t_{cool,req}$ is determined by mode transition manager 818 based on the relative humidity of building zone 702 at time $t_d$ (referred to as $RH_{t_d}$). In some embodiments, the required amount of time $t_{cool,req}$ is determined based on $RH_{t_d}$ and a desired/target relative humidity of building zone 702 at time $t_h$ (referred to as $RH_{target}$).

In some embodiments, mode transition manager 818 uses a function to determine $t_{cool,req}$:

$$t_{cool,req}=f(RH_{t_d},RH_{target},p_{equipment},p_{zone})$$

where $RH_{t_d}$ is the relative humidity of building zone 702 at time $t_d$, $RH_{target}$ is the target/desired relative humidity of building zone 702 at time $t_h$ (i.e., a desired relative humidity value of building zone 702 when building zone 702 becomes occupied), $p_{equipment}$ is a vector of one or more performance variables of building equipment 712 (e.g., a rate at which building equipment 712 can remove humidity from building zone 702, a rate at which building equipment 712 can change cool building zone 702, etc.), $p_{zone}$ is a vector of one or more system parameters of building zone 702 (e.g., one or more heat capacitances of building zone 702, system identification parameters that indicate how building zone 702 stores or dissipates heat, system identification parameters that indicate the relative humidity of building zone 702 with respect to cooling, etc.), and f is a relationship that relates $RH_{t_d}$, $RH_{target}$, $p_{equipment}$, and $p_{zone}$ to Mode transition manager 818 can also determine $t_{cool,req}$ using a difference between $RH_{t_d}$ and $RH_{target}$. For example, mode transition manager 818 can use the function: $t_{cool,req}=f(\Delta RH,p_{equipment},p_{zone})$ where $\Delta RH=RH_{target}-RH_{t_d}$.

In some embodiments, the target relative humidity $RH_{target}$ is some predetermined value. For example, the target relative humidity $RH_{target}$ can be a relative humidity that is below the relative humidity setpoint $RH_{sp}$ by some predetermined amount. This can account for increases in the relative humidity of building zone 702 during the heating period 1324.

In some embodiments, the temperature at time $t_h$ (i.e., $T_{t_h}$) is dependent on dehumidification period 1322 (e.g., dependent on the duration of dehumidification period 1322, dependent on the rate of cooling over dehumidification period 1322, etc.). For example, during dehumidification period 1322, the temperature in building zone 702 may decrease (as shown in graph 1304). In some embodiments, mode transition manager 818 is configured to estimate the expected temperature at time $t_h$ based on the time duration of dehumidification period 1322. For example, mode transition manager 818 can determine/estimate the expected temperature at time $t_h$ based on the duration of dehumidification period 1322, the rate of heat added/removed from building zone 702 over dehumidification period 1322, and system properties of building zone 702 (e.g., using a relationship that relates heat added/removed to the temperature $T_{zone}$ in building zone 702).

The relative humidity $RH_{zone}$ of building zone 702 decreases over the dehumidification period 1322 (shown by series 1314 of graph 1306), while the temperature of building zone 702 may also decrease over dehumidification period 1322. During heating period 1324, the relative humidity of building zone 702 may increase slightly, while the temperature of building zone 1304 also increases. PHC 650 can operate building equipment 712 in the cooling mode over dehumidification period 1322 to drive the relative humidity of building zone 702 to a target/desired relative humidity (while also possibly decreasing the temperature of building zone 702) and then operate building equipment 712 in the heating mode over heating period 1324 to drive the temperature of building zone 702 to a desired/target temperature value (e.g., to drive $T_{zone}$ to $T_{sp}$). In this way, PHC 650 can operate single-coil building equipment to prepare building zone 702 for occupancy. The single-coil building equipment can be operated to achieve both a desired/target temperature that is comfortable for occupants of building zone 702, as well as a relative humidity that is comfortable for occupants of building zone 702. Advantageously, PHC 650 can operate single-coil building equipment to satisfy comfort constraints for occupants of building zone 702 by pre-cooling/pre-dehumidifying and then pre-heating building zone 702 such that the temperature of building zone 702 and the relative humidity of building zone 702 are within comfortable ranges before or when building zone 702 is occupied. Mode transition manager 818 can perform any of the analysis, operations, functionality, techniques, etc., described herein to pre-cool and then pre-heat building zone 702 for occupancy.

After building zone 702 becomes occupied, PHC 650 can operate building equipment 712 to maintain the temperature $T_{zone}$ of building zone 702 within the acceptable range (e.g., within $T_{min}$ and $T_{max}$). For example, PHC 650 can transition building equipment 712 between the heating mode and the cooling mode to maintain the temperature $T_{zone}$ of building zone 702 within the acceptable range. The relative humidity of building zone 702 may fluctuate during the occupancy of building zone 702. In some embodiments, PHC 650 operates building equipment 712 in the cooling mode during occupancy of building zone 702 to dehumidify building zone 702. In some embodiments, PHC 650 operates building equipment 712 between the heating mode, the cooling mode, and a standby mode. For example, PHC 650 can operate building equipment 712 between the cooling mode and the standby mode during summer time (or when the outdoor temperature is above some threshold value), and between the heating mode and the standby mode during winter time (or when the outdoor temperature is below some threshold value). In some embodiments, PHC 650 operates building equipment 712 to drive the temperature $T_{zone}$ of building zone 702 between the minimum allowable/acceptable/desired temperature $T_{min}$ and the maximum allowable/acceptable/desired temperature $T_{max}$. In this way, building zone 702 can still be dehumidified (e.g., when the zone temperature $T_{zone}$ of building zone 702 is decreased due to building equipment 712 operating in the cooling mode) while building zone 702 is occupied.

Advantageously, PHC 650 and building equipment 712 reduce the need for double-coiled building equipment. PHC 650 can operate single-coil building equipment such that both the temperature and the relative humidity of building zone 702 are within an acceptable/comfortable range. This reduces expenses associated with purchasing, installing, maintaining, etc., double-coiled building equipment 712, thereby reducing costs associated with the building. The single-coil building equipment can be used to both meet and maintain an acceptable/comfortable relative humidity in building zone 702 and to meet and maintain an acceptable temperature in building zone 702.

PHC State Diagram

Figure 11:
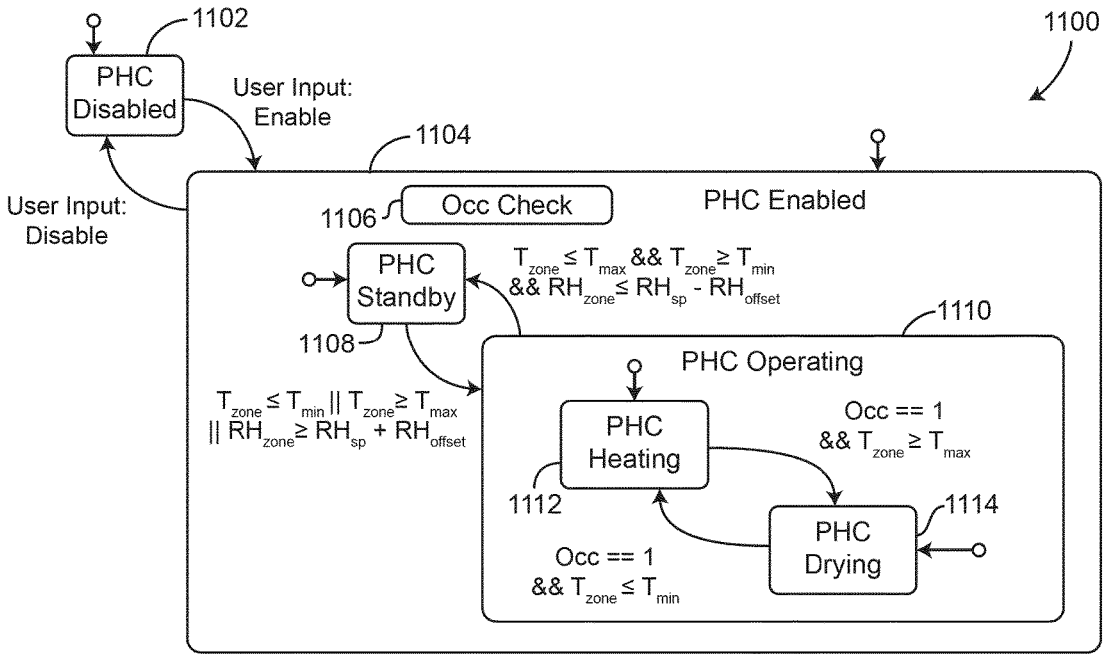
FIG. 11 is a state diagram that the predictive heating controller of FIG. 7 can use, according to some embodiments.

Referring now to FIG. 11, a state diagram 1100 that shows the operation of mode transition manager 818 is shown. State diagram 1100 illustrates various states 1102, 1104, 1108, 1110, 1112, and 1114 that mode transition manager 818 can transition between. State diagram 1100 also shows logical conditions that are met to transition between the various states.

State diagram 1100 includes a disabled state 1102, according to some embodiments. In some embodiments, mode transition manager 818 (and/or PHC 650) is in disabled state 1102 by default. In some embodiments, mode transition manager 818 (and/or PHC 650) is in disabled state 1102 until PHC 650 receives a command from a user/occupant to transition out of disable state 1101. In some embodiments, PHC 650 transitions out of disable state 1102 into an enabled state 1104 in response to receiving a user input from user interface 710 to transition PHC 650 into enabled state 1104. For example, the user input may be a command to enable the pre-heat/pre-cool functionality of PHC 650. Likewise, PHC 650 can transition out of enabled state 1104 into disabled state 1102 in response to receiving a user input to transition PHC 650 into disabled state 1102 (e.g., in response to receiving a command from a user/occupant/building manager to disable the pre-heat/pre-cool functionality of PHC 650).

When PHC 650 is in the enabled state 1104, PHC 650 may perform an occupancy check 1106. In some embodiments, occupancy check 1106 is performed by occupancy manager 810 using any of the methods, techniques, functionality, operations, etc., described in greater detail above with reference to FIGS. 8 and 9. In some embodiments, PHC 650 can use the determined occupancy that results from occupancy check 1106 to determine when to transition building equipment 712 into the cooling mode or the heating mode.

State diagram 1100 includes a standby state 1108, and an operational state 1110, according to some embodiments. In some embodiments, PHC 650 transitions into standby state 1108 by default. PHC 650 may transition into standby state 1108 in response to PHC 650 transitioning into enabled state 1104. In some embodiments, PHC 650 remains in standby state 1108 until one or more logical conditions are met. PHC 650 can transition into operational state 1110 in response to at least one of the zone temperature $T_{zone}$ being less than or equal to the minimum allowable temperature $T_{min}$ (e.g., $T_{zone} \leq T_{min}$) or the zone temperature $T_{zone}$ being greater than or equal to the maximum allowable temperature $T_{max}$ (e.g., $T_{zone} \geq T_{max}$) or the relative humidity $RH_{zone}$ of building zone 702 being greater than or equal to the relative humidity setpoint $RH_{sp}$ plus a relative humidity offset value $RH_{offset}$ (e.g., $RH_{zone} \geq RH_{sp}+RH_{offset}$). For example, PHC 650 can transition from standby state 1108 into operational state 1110 in response to $T_{zone} \leq T_{min}$ OR $T_{zone} \geq T_{max}$ OR $RH_{zone} \geq RH_{sp}+RH_{offset}$.

PHC 650 can transition out of operational state 1110 into standby state 1108 in response to the logical condition $T_{zone} \leq T_{max}$ AND $T_{zone} \geq T_{min}$ AND $RH_{zone} \leq RH_{sp}+RH_{offset}$. This logical condition indicates that the zone temperature $T_{zone}$ of building zone 702 is within the acceptable range defined by $T_{min}$ and $T_{max}$ and that the relative humidity $RH_{zone}$ is less than the relative humidity setpoint $RH_{sp}$ by at least $RH_{offset}$.

Standby state 1108 is a state of PHC 650 when building equipment 712 is not being operated in either the cooling mode or the heating mode but is activated. For example, when in standby state 1108, PHC 650 may transition building equipment 712 into a standby mode such that building equipment 712 is activated but is not operating in either the cooling mode or the heating mode (e.g., building equipment 712 is dormant and is not providing heating or cooling to building zone 702). Standby state 1108 can be transitioned into to reduce power consumption of building equipment 712.

Operational state 1110 includes a heating state 1112 and a drying/dehumidification state 1114, according to some embodiments. In some embodiments, PHC 650 transitions into heating state 1112 by default. For example, PHC 650 may transition into heating state 1112 by default in response to transitioning into operational state 1110. In some embodiments, PHC 650 transitions into cooling state 1114 by default in response to transitioning into operational state 1110. In some embodiments, PHC 650 only transitions into operational state 1110 in response to occupancy being expected in building zone 702 within some predetermined amount of time (e.g., within an hour, within half an hour, within twenty minutes, etc.).

PHC 650 can transition between heating state 1112 and drying/dehumidification state 1114 in response to one or more logical conditions being met. In some embodiments, PHC 650 transitions from heating state 1112 to drying/dehumidification state 1114 in response to occupants present in building zone 702 (or in response to occupants expected to be present in building zone 702 within some predetermined amount of time) (e.g., occ=1) AND the zone temperature $T_{zone}$ of building zone 702 being greater than or equal to the maximum allowable temperature $T_{max}$ of building zone 701 (e.g., $T_{zone} \geq T_{max}$). For example, PHC 650 can transition into drying/dehumidification state 1114 in response to the logical condition occ=1 AND $T_{zone} \geq T_{max}$ being satisfied (where occ=1 indicates either that occupants are currently present in building zone 702, or that occupants will be present in building zone 702 within a predetermined time period). PHC 650 can transition into heating state 1112 in response to occupants being present in building zone 702 (or occupants expected to be present in building zone 702 within some predetermined time duration) and in response to the zone temperature $T_{zone}$ of building zone 702 being less than or equal to the minimum allowable temperature $T_{min}$. For example, PHC 650 can transition into heating state 1112 in response to the logical condition occ=1 AND $T_{zone} \leq T_{min}$ being met (where occ=1 indicates either that occupants are currently present in building zone 702, or that occupants will be present in building zone 702 within a predetermined time period).

In some embodiments, when PHC 650 is in heating state 1112, mode transition manager 818 provides control signal generator 820 with an indication that building equipment 712 should be operated in the heating mode. Control signal generator 820 can generate and provide control signals to building equipment 712 to heat building zone 702. Likewise, when PHC 650 is in drying/dehumidification/cooling state 1114, mode selection manager 818 provides control signal generator 820 with an indication that building equipment 712 should be operated in the cooling mode. Control signal generator 820 can generate and provide control signals to building equipment 712 to cool/dehumidify/dry building zone 702.

PHC 650 can periodically check the various logical conditions described herein to determine into which state it should transition. In some embodiments, PHC 650 checks if any of the logical conditions are satisfied in response to receiving sensory information from any sensors, or in response to receiving updated occupancy schedules from scheduling service 704.

Predictive Heating Control Process

Figure 10:
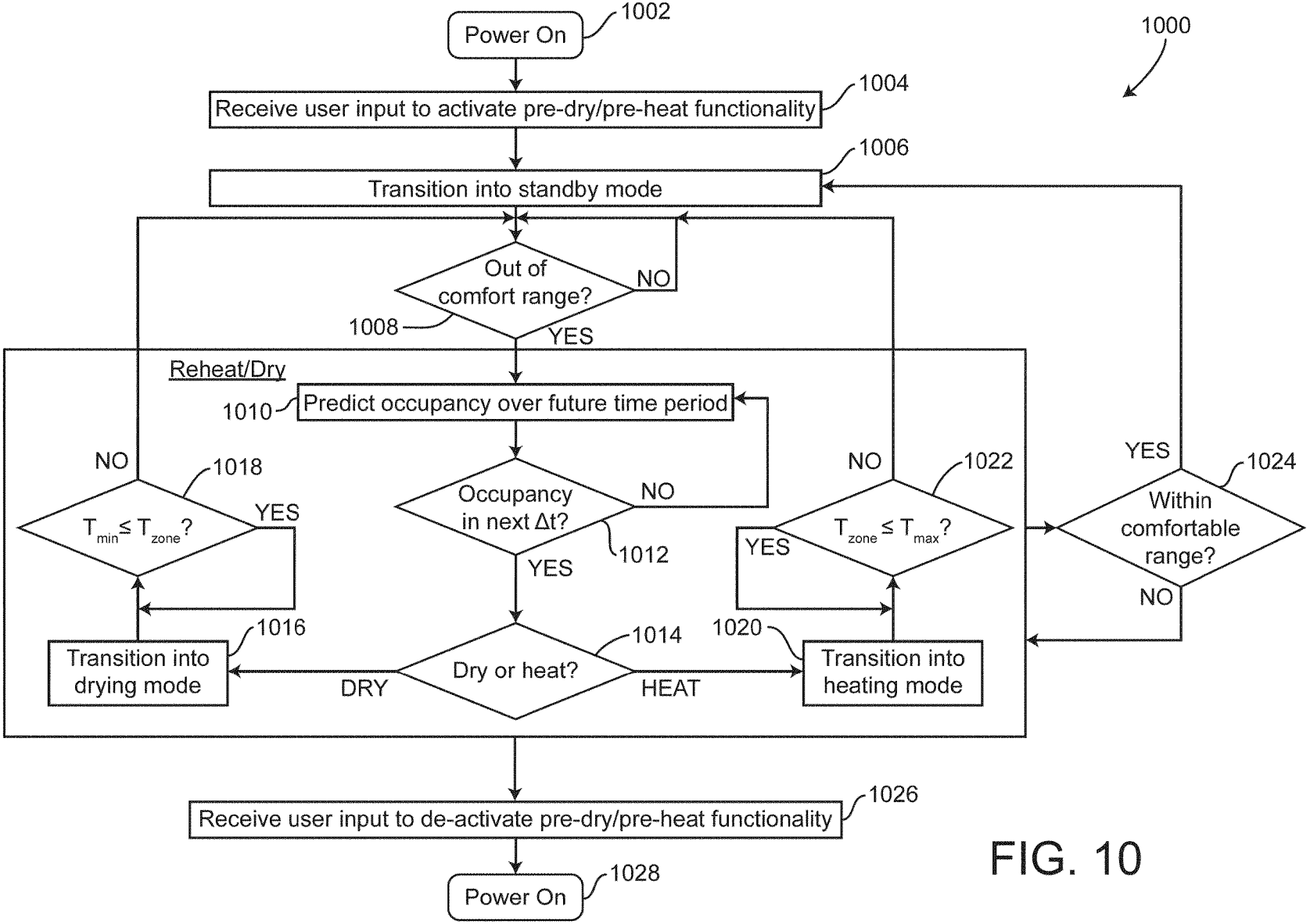
FIG. 10 is a flow diagram of a process for performing predictive heating control, according to some embodiments.

Referring now to FIG. 10, a process 1000 for operating single-coil building equipment to both pre-dehumidify and pre-heat a building zone is shown. Process 1000 includes steps 1002-1028, according to some embodiments. In some embodiments, process 1000 is performed by predictive heating system 700. In some embodiments, process 1000 is performed by PHC 650. PHC 650 can perform process 1000 to operate building equipment 712 to both drive the humidity of building zone 702 towards an acceptable value and to drive the temperature of building zone 702 towards and acceptable value before building zone 702 becomes occupied.

Process 1000 includes powering on PHC 650 (step 1002), according to some embodiments. In some embodiments, step 1002 is performed by a building administrator, an occupant, a user, etc. In some embodiments, step 1002 includes providing power to predictive heating system 700.

Process 1000 includes receiving a user input to activate the pre-dry/pre-heat functionality (step 1004), according to some embodiments. In some embodiments, step 1004 is performed by PHC 650. PHC 650 can receive a user input from user interface 710 to activate the dehumidifying and heating functionality of predictive heating system 700. A user may activate the predictive heating/cooling functionality of predictive heating system 700 during rainy seasons (e.g., when building zone 702 will likely need to be dehumidified to satisfy comfortable relative humidity conditions).

Process 1000 includes transitioning into a standby mode (step 1006), according to some embodiments. In some embodiments, step 1006 is performed in response to step 1004. In some embodiments, step 1006 includes transitioning PHC 650 into standby state 1108. In some embodiments, step 1006 includes activating building equipment 712 but not operating building equipment 712 in the heating mode or the cooling/drying mode. In some embodiments, step 1006 is performed automatically in response to receiving a user input to activate the pre/re-heat and drying functionality of predictive heating system 700.

Process 1000 includes checking if environmental conditions of building zone 702 are outside of a comfortable range (step 1008), according to some embodiments. In some embodiments, step 1008 includes checking the temperature $T_{zone}$ of building zone 702 to determine if the temperature exceeds the maximum allowable temperature or to determine if the temperature is below the minimum allowable temperature. In some embodiments, step 1008 includes checking the relative humidity of building zone 702 to determine if the relative humidity $RH_{zone}$ of building zone 702 is less than the setpoint relative humidity $RH_{sp}$ (e.g., a comfortable relative humidity value) by some predetermined amount (e.g., if the relative humidity $RH_{zone}$ of building zone 702 is less than the setpoint relative humidity $RH_{sp}$ by the offset amount $RH_{offset}$). In some embodiments, if any of the temperature and the relative humidity of building zone 702 are outside of their respective ranges (e.g., the temperature of building zone 702 is greater than the maximum allowable temperature, or the temperature of building zone 702 is less than the maximum allowable temperature, or the relative humidity is greater than the desired/setpoint relative humidity by some predetermined amount, etc.), process 1000 proceeds to step 1010 and activates the drying/dehumidification and pre/reheating functionality of predictive heating system 700 (step 1008, "YES"). For example, step 1008 can include checking the logical condition $T_{zone} \leq T_{min}$ OR $T_{zone} \geq T_{max}$ OR $RH_{zone} \geq RH_{sp} + RH_{offset}$ and if the logical condition is satisfied, process 1000 proceeds to step 1010 (step 1008, "YES"). If the logical condition is not met (e.g., all of the environmental conditions are acceptable/comfortable), PHC 650 remains in the standby mode (step 1008, "NO"). in some embodiments, PHC 650 continues to check the environmental conditions (e.g., $T_{zone}$ and $RH_{zone}$) until the logical condition is met and process 1000 proceeds to step 1010.

Process 1000 includes predicting occupancy of building zone 702 over a future time period (step 1010), according to some embodiments. In some embodiments, step 1010 is performed by occupancy manager 810. In some embodiments, step 1010 includes performing process 1200 to predict occupancy of building zone 702 over a future time period (e.g., the next day, the next hour, the next half hour, the next twenty minutes, etc.).

Process 1000 includes checking if occupancy is expected in building zone 702 within a future time period Δt (step 1012), according to some embodiments. In some embodiments, step 1012 includes using the results of step 1010 to check if occupancy is expected or likely at any time within the future time period Δt. In some embodiments, if occupancy is expected in the future time period Δt (step 1012, "YES"), process 1000 proceeds to step 1014. In some embodiments, if occupancy is not expected in the future time period Δt (step 1012, "NO"), process 1000 returns to step 1010. In some embodiments, step 1012 is performed by occupancy manager 810 and/or mode transition manager 818.

Process 1000 includes determining if building equipment 712 should be transitioned into the drying mode (e.g., the cooling mode, the dehumidification mode, etc.) or the heating mode (step 1014), according to some embodiments. In some embodiments, step 1014 is performed by mode transition manager 818. In some embodiments, step 1014 includes performing any of the functionality of mode transition manager 818 described in greater detail above with reference to FIGS. 8 and 13. In some embodiments, step 1014 includes using the logical conditions shown in state diagram 1100 described in greater detail above with reference to FIG. 11. For example, step 1014 can include checking if the logical condition occ=1 AND $T_{zone} \leq T_{min}$ to determine if building equipment 712 should be transitioned into the heating mode. If the aforementioned logical condition is met, process 1000 proceeds to step 1014 (step 1014, "HEAT"). Step 1014 can also include checking the logical condition occ=1 AND $T_{zone} \geq T_{max}$ to determine if building equipment 712 should be transitioned into the cooling mode. If this logical condition is satisfied, process 1000 proceeds to step 1016 (step 1014, "DRY").

Process 1000 includes transitioning into the drying mode of operation (step 1016), according to some embodiments. In some embodiments, step 1016 is performed in response to determining (at step 1014) that building equipment 712 should be transitioned into the drying/dehumidifying mode of operation (step 1014, "DRY"). In some embodiments, step 1016 includes generating and providing control signals (performed by control signal generator 820) to building equipment 712. In some embodiments, mode transition manager 818 provides control signal generator 820 with an indication that building equipment 712 should be operated in the drying/cooling/dehumidifying mode of operation, and control signal generator 820 generates and provides control signals to building equipment 712 to operate building equipment 712 in the cooling/drying/dehumidifying mode of operation to reduce the relative humidity in building zone 702 and to decrease the temperature $T_{zone}$ in building zone 702.

Process 1000 includes checking if the temperature $T_{zone}$ of building zone 702 is greater than or equal to the minimum allowable temperature $T_{min}$ (step 1018), according to some embodiments. In some embodiments, step 1018 includes checking if $T_{zone}$ is less than or equal to $T_{max}$ and if $T_{zone}$ is greater than or equal to In some embodiments, if the temperature $T_{zone}$ of building zone 702 is greater than or equal to the minimum allowable temperature $T_{min}$ (step 1018, "YES"), PHC 650 maintains building equipment 712 in the drying/cooling/dehumidifying mode of operation. In some embodiments, if the zone temperature is less than the minimum allowable temperature (i.e., if $T_{zone}<T_{min}$), process 1000 returns to step 1010 or returns to step 1008 (step 1018, "NO"). In some embodiments, if the temperature $T_{zone}$ of building zone 702 is greater than the maximum allowable temperature (i.e., if $T_{zone}>T_{max}$) process 1000 returns to step 1016.

Process 1000 includes transitioning building equipment 712 into the heating mode of operation (step 1020), according to some embodiments. In some embodiments, step 1020 is performed in response to determining that building equipment 712 should be transitioned into the heating mode of operation (step 1014, "HEAT"). In some embodiments, step 1020 is performed by control signal generator 820 and/or mode transition manager 818 similar to step 1016.

Process 1000 includes checking if the temperature $T_{zone}$ of building zone 702 is within the acceptable/desired/allowable range (step 1022), according to some embodiments. In some embodiments, step 1022 includes checking if $T_{zone}$ is less than or equal to $T_{max}$ and/or if $T_{zone}$ is greater than or equal to $T_{min}$ some embodiments, if the temperature $T_{zone}$ of building zone 702 is within the acceptable range or if the temperature $T_{zone}$ of building zone 702 is less than or equal to the maximum allowable temperature $T_{max}$, (step 1022, "YES"), PHC 650 maintains building equipment 712 in the heating mode of operation. In some embodiments, if the zone temperature is greater than the maximum allowable temperature (i.e., if $T_{zone}>T_{max}$), process 1000 returns to step 1010 or returns to step 1008 (step 1022, "NO"). In some embodiments, if the temperature $T_{zone}$ of building zone 702 is less than the minimum allowable temperature (i.e., if $T_{zone}<T_{min}$) process 1000 returns to step 1020 and continues heating building zone 702.

Process 1000 includes receiving a user input to de-activate the pre-dry/pre-heat functionality of predictive heating system 700 (step 1026), according to some embodiments. In some embodiments, step 1026 is performed concurrently with any of steps 1010-1024. In some embodiments, step 1026 is performed by receiving user inputs/commands via user interface 710. In some embodiments, if at any time while steps 1010-1024 are being performed, PHC 650 receives a user input to de-activate the pre-dry/pre-heat operation of building zone 702, PHC 650 transitions into the standby mode (e.g., returns to step 1006) or powers off (proceeds to step 1028).

Process 1000 includes checking if any monitored environmental conditions (e.g., relative humidity $RH_{zone}$ of building zone 702, temperature $T_{zone}$ of building zone 702) are within a comfortable range (step 1024), according to some embodiments. In some embodiments, step 1024 is performed concurrently with any of steps 1010-1022. In some embodiments, if the environmental conditions are within the comfortable range (e.g., if $RH_{zone}<RH_{sp}-RH_{offset}$ AND $T_{min} \leq T_{zone}$ (step 1024, "YES"), process 1000 returns to step 1006. In some embodiments, if the environmental conditions are not within the comfortable range (e.g., if $RH_{zone}>RH_{sp}+RH_{offset}$ OR $T_{zone}>T_{max}$ OR $T_{zone}<T_{min}$), process 1000 continues performing steps 1010-1022.

Step 1022 and step 1018 can be performed by checking air intake temperature of an indoor unit of predictive heating system 700 or by monitoring the temperature in building zone 702.

Figure 16:
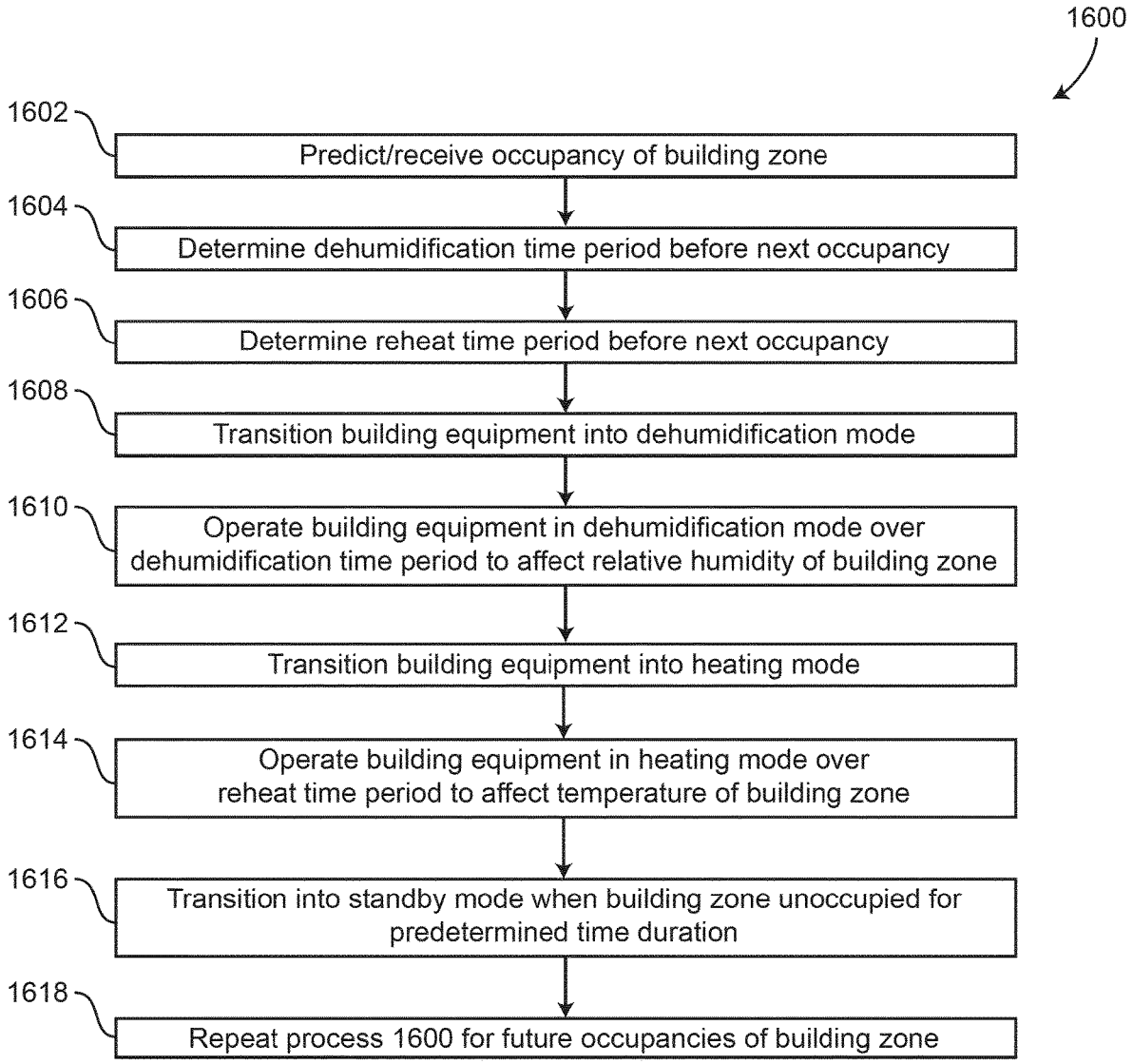
FIG. 16 is a flow diagram of a process for performing predictive heating control, according to some embodiments.

Referring now to FIG. 16, a process 1600 for operating building equipment is shown. Process 1600 includes steps 1602-1618 and can be performed by predictive heating system 700, or the various components, equipment, devices, sensors, controllers, etc., thereof Process 1600 includes predicting/receiving occupancy of a building zone (step 1602), according to some embodiments. In some embodiments, step 1602 includes performing process 1200. Step 1602 or process 1200 can be performed by PCH 650. Particularly, step 1602 or process 1200 may be performed by occupancy manager 810.

Process 1600 includes determining a dehumidification time period before the next occupancy (step 1604), according to some embodiments. In some embodiments, the dehumidification time period is determined based on a required humidity change (e.g., a required change in relative humidity $RH_{zone}$ of building zone 702). In some embodiments, the dehumidification time period is dehumidification period 1322. In some embodiments, the dehumidification time period is a required amount of time that building equipment 712 must operate in the cooling/dehumidification mode to drive the relative humidity $RH_{zone}$ of building zone 702 to an acceptable level. In some embodiments, step 1604 is performed by mode transition manager 818 using any of the techniques, functionality, methods, approaches, etc., described in greater detail hereinabove with reference to FIGS. 9 and 13.

Process 1600 includes determining a reheat time period before the next occupancy (step 1606), according to some embodiments. In some embodiments, the reheat time period is a time period immediately after the dehumidification time period. In some embodiments, the reheat time period is heating period 1324. In some embodiments, step 1606 is performed by PHC 650, or more specifically, by mode transition manager 818. In some embodiments, mode transition manager 818 is configured to use any of the techniques, functionality, methods, approaches, etc., described in greater detail above with reference to FIGS. 9 and 13 to determine the reheat time period. In some embodiments, step 1606 is performed concurrently with step 1604.

Process 1600 includes transitioning building equipment into the dehumidification mode (step 1608), according to some embodiments. In some embodiments, step 1608 is performed at the beginning of the dehumidification time period as determined in step 1604. In some embodiments, step 1608 is performed by mode transition manager 818 and control signal generator 820. For example, mode transition manager 818 can provide control signal generator 820 with a command to transition building equipment 712 into the dehumidification mode to perform step 1608.

Process 1600 includes operating building equipment in the dehumidification mode over the dehumidification time period to affect humidity (e.g., relative humidity) of the building zone (step 1610), according to some embodiments. In some embodiments, step 1610 is performed by control signal generator 820. For example, control signal generator 820 can continuously provide building equipment 712 with control signals over the entirety of the dehumidification time period such that building equipment 712 operates to affect (e.g., decrease) the relative humidity of building zone 702 over the dehumidification time period. In some embodiments, control signal generator 820 continues to provide control signals to building equipment 712 to cool/dehumidify building zone 702 until it receives a command from mode transition manager 818 to transition into a different mode of operation.

Process 1600 includes transitioning the building equipment (e.g., building equipment 712) into the heating mode (step 1612), according to some embodiments. In some embodiments, step 1612 is performed in response to completing step 1610. In some embodiments, step 1612 is performed at an end of the dehumidification period. In some embodiments, step 1612 is performed at a beginning of the reheat time period. In some embodiments, step 1612 is performed by mode transition manager 818 and control signal generator 820 similar to step 1608.

Process 1600 includes operating building equipment in the heating mode over the reheat time period to affect a temperature (e.g., $T_{zone}$) of the building zone (e.g., building zone 702) (step 1614), according to some embodiments. In some embodiments, step 1614 is performed over the entirety of the reheat time period. In some embodiments, step 1614 is performed to achieve a comfortable/desired temperature in building zone 702 before building zone 702 is occupied. In some embodiments, step 1614 is performed by control signal generator 820 and mode transition manager 818 similar to step 1610.

Process 1600 includes transitioning into standby mode when the building zone is unoccupied for a predetermined time duration (step 1616), according to some embodiments. In some embodiments, step 1616 is performed by mode transition manager 818 and control signal generator 820 in response to receiving sensory information from occupancy sensor 708 for a predetermined time duration that indicates occupants are not present in building zone 702. In some embodiments, the standby mode is a power-saving mode when building equipment 712 is not providing heating or cooling to building zone 702.

Process 1600 includes repeating process 1600 for future occupancies of the building zone (e.g., building zone 702), according to some embodiments. In some embodiments, process 1600 is repeated indefinitely for scheduled/predicted occupancies of building zone 702.

Process 1600 can be performed for scheduled or predicted occupancy. In some embodiments, process 1600 is ended (regardless of what step is currently being performed) if PHC 650 receives sensory information from occupancy sensor 708 that an occupant has entered building zone 702. If PHC 650 receives sensor information from occupancy sensor 708 that an occupant has entered building zone 702, PHC 650 may operate building equipment 712 to achieve a comfortable temperature in building zone 702. In some embodiments, process 1600 is only performed if a user has enabled pre-heat/pre-dehumidification of building zone 702.

Occupancy Prediction Process

Figure 12:
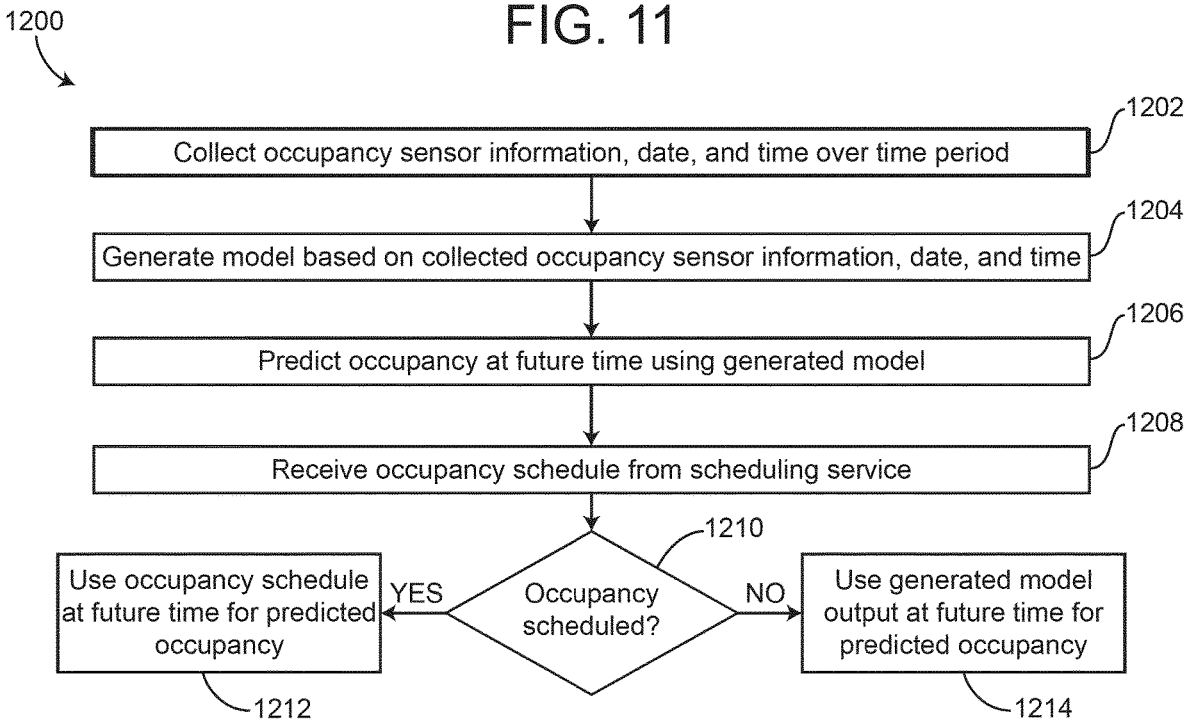
FIG. 12 is a flow diagram of a process for predicting occupancy of a building room, according to some embodiments.

Referring now to FIG. 12, a process 1200 for predicting occupancy of a building zone, room, space, etc., (e.g., building zone 702) is shown. Process 1200 includes steps 1202-1214, according to some embodiments. In some embodiments, process 1200 is performed by occupancy manager 810. Process 1200 can be performed by occupancy manager 810 to predict occupancy of building zone 702 at future times.

Process 1200 includes collecting occupancy sensor information, date, and time over a time period (step 1202), according to some embodiments. In some embodiments, step 1202 is performed by occupancy manager 810. Specifically, step 1202 can be performed by data collector 822 and clock 824. Data collector 822 can collect occupancy sensor information/data from occupancy sensor 708 over a time period, as well as corresponding dates, times, day type, etc., of each sample from clock 824. In some embodiments, data collector 822 provides the collected occupancy sensor information, and corresponding dates, times, day types, etc., to model generator 826.

Process 1200 includes generating a model based on collected occupancy sensor information, date, time, day type, etc., (step 1204), according to some embodiments. In some embodiments, step 1204 includes generating a model to predict occupancy based on the occupancy sensor information and corresponding date, time, day type, etc., collected in step 1202. In some embodiments, step 1204 is performed by model generator 826. Step 1204 can include using a neural network, a multi-variable regression, etc., or any other model generation technique to generate the model to predict occupancy of the building zone. Step 1204 can include providing the generated model to occupancy predictor 828.

Process 1200 includes predicting occupancy of the building zone or room using the model generated in step 1204 (step 1206), according to some embodiments. In some embodiments, step 1206 is performed by occupancy predictor 828. In some embodiments, occupancy predictor 828 uses the generated model received from model generator 826 and one or more future (or current) times, dates, day types, etc., to predict occupancy of the building zone/room/space at one or more future times (or over a future time period). In some embodiments, step 1206 includes outputting the predicted occupancy of the building zone to prediction manager 830.

Process 1200 includes receiving an occupancy schedule from a scheduling service (step 1208), according to some embodiments. In some embodiments, step 1208 is performed by occupancy manager 810, or more specifically, prediction manager 830. In some embodiments, the occupancy schedule is any of a room reservation schedule, a work schedule, etc. In some embodiments, the occupancy schedule is for a future and/or a previous time period.

Process 1200 includes determining if occupancy is scheduled at one or more future times (step 1210), according to some embodiments. In some embodiments, step 1210 includes checking the received occupancy schedule at one or more future times to determine if occupancy is scheduled at any of the one or more future times. In some embodiments, step 1210 is performed by prediction manager 830. In some embodiments, process 1200 proceeds to step 1214 in response to determining that occupancy is not scheduled at a particular future time (or that occupancy is not scheduled at any point within a future time horizon). In some embodiments, process 1200 proceeds to step 1212 in response to determining that occupancy is scheduled at the particular future time (or that occupancy is scheduled at some point within a future time horizon).

Process 1200 includes using the occupancy that is scheduled (e.g., the occupancy schedule received in step 1208) as the predicted occupancy in response to determining that occupancy is scheduled over the future time horizon (e.g., step 1210 "YES"), according to some embodiments. In some embodiments, step 1212 is performed by prediction manager 830. In some embodiments, prediction manager 830 is configured to use the scheduled occupancy of building zone 702 as the predicted occupancy of building zone 702 if the received occupancy schedule includes room reservations.

Process 1200 includes using the generated model outputs as the predicted occupancy (step 1214) in response to determining that occupancy is not scheduled at any point in time over the future time horizon (step 1210, "NO"), according to some embodiments. In some embodiments, step 1214 is performed by prediction manager 830. In some embodiments, prediction manager 830 is configured to use the predicted occupancy as output by the generated model (e.g., the model generated in step 1204 by model generator 826) in response to determining that occupancy is not scheduled for building zone 702 over the future time horizon (step 1210, "NO"). In this way, prediction manager 830 can use both the occupancy schedule received from scheduling service 704 in addition to predicted occupancy as output by occupancy predictor 828 to determine if occupants will be present in building zone 702 at a future time (or over a future time horizon).

Sample Graphs

Figure 14:
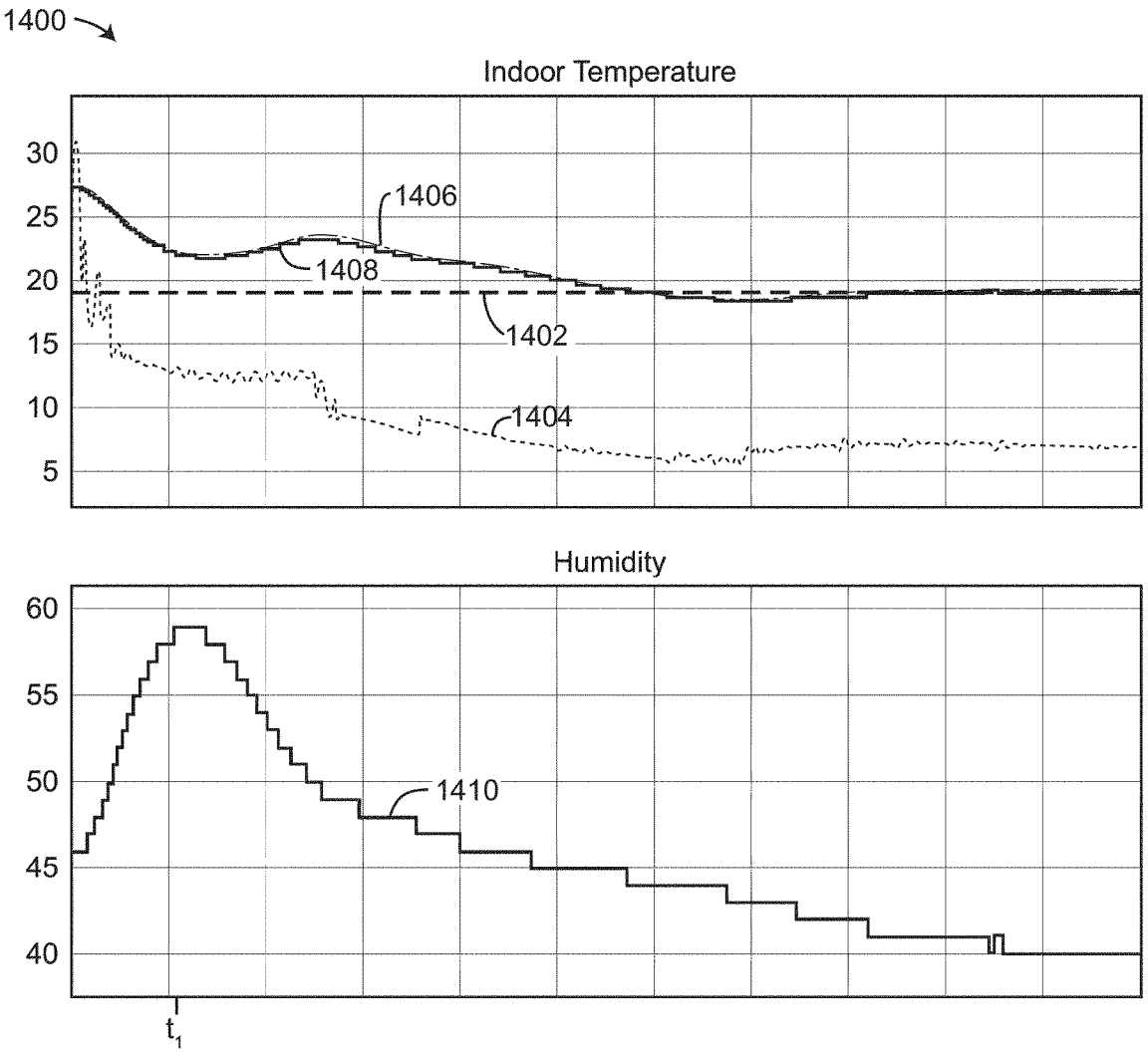
FIG. 14 is a graph of zone temperature(s) and zone relative humidity over time illustrating dehumidification, according to some embodiments.
Figure 15:
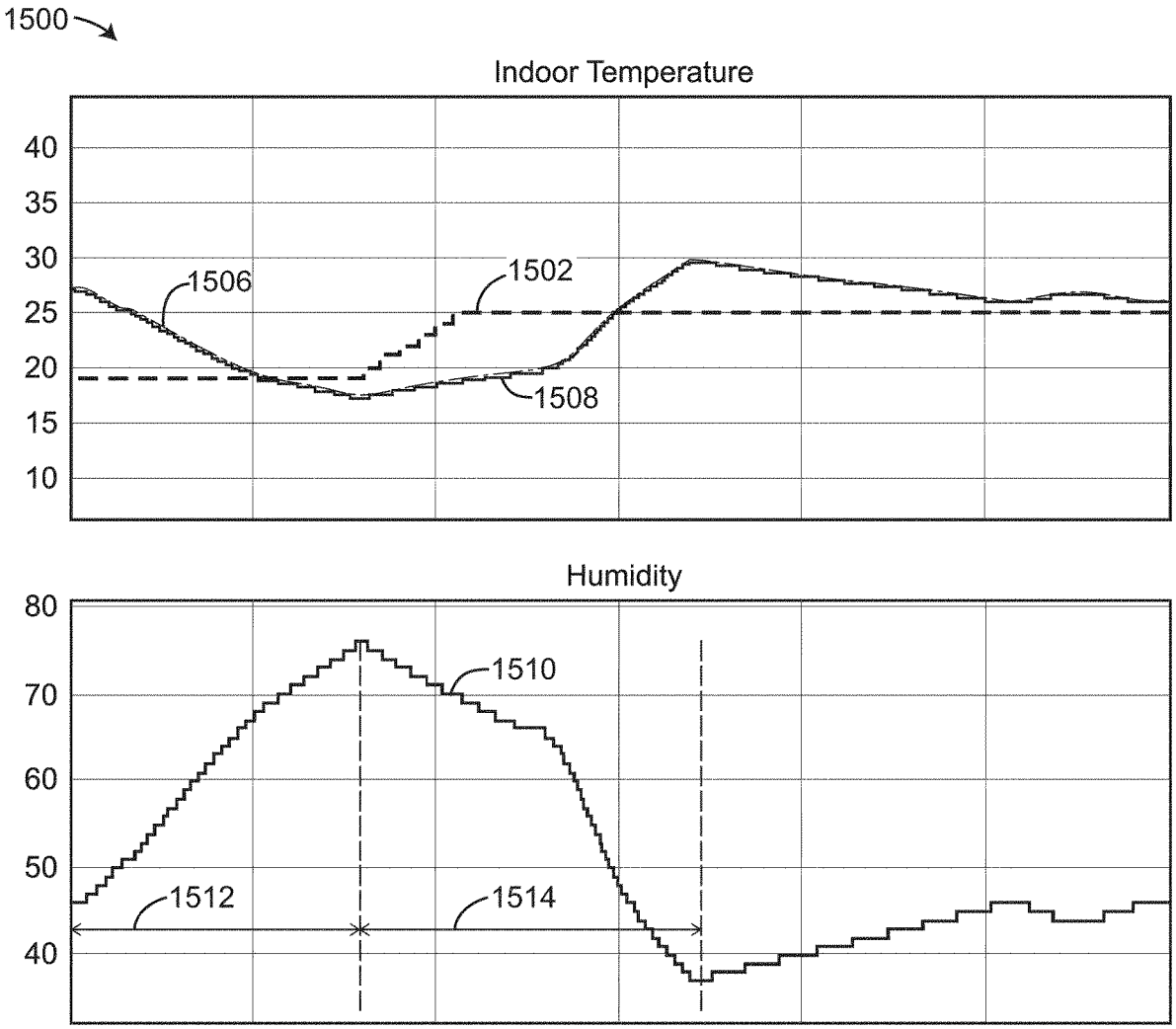
FIG. 15 is a graph of zone temperature(s) and zone relative humidity over time illustrating dehumidification and pre/re-heat, according to some embodiments.

Referring now to FIGS. 14 and 15, graphs 1400 and 1500 show dehumidification and reheat dehumidification of a building zone, respectively, according to some embodiments. Graphs 1400 and 1500 demonstrate simulation results.

Graph 1400 includes a temperature plot (upper plot) that shows temperature (the Y-axis) over time (the X-axis). The temperature plot includes a temperature setpoint series 1402 that illustrates the zone temperature setpoint $T_{sp}$ over time. As shown in the temperature plot of graph 1400, the temperature setpoint $T_{sp}$ remains constant over time. In some embodiments, the temperature setpoint $T_{sp}$ can change over time (e.g., if an occupant or a building administrator changes the temperature setpoint of building zone 702).

Referring still to FIG. 14, the temperature plot of graph 1400 includes a discrete zone temperature series 1408 and an analog zone temperature series 1406, according to some embodiments. In some embodiments, zone temperature series 1408/1406 illustrate the temperature $T_{zone}$ of building zone 702 over time. Graph 1400 also includes a supply air temperature series 1404, according to some embodiments. Supply air temperature series 1404 shows the trend of the supply air temperature provided to the room (e.g., building zone 702) over time during dehumidification.

The humidity plot of graph 1400 includes a humidity series 1410 that illustrates the relative humidity, $RH_{zone}$, of building zone 702 over time, according to some embodiments. The humidity plot of graph 1400 and the temperature plot of graph 1400 are both over the same time period. At time $t_1$, building zone 702 is dehumidified (e.g., cooled) by PHC 650 and building equipment 712, thereby decreasing the relative humidity $RH_{zone}$ of building zone 702 over time thereafter. Likewise, as building zone 702 is dehumidified, the temperature $T_{zone}$ of building zone 702 may decrease as represented by zone temperature series 1408. In this way, building zone 702 can be dehumidified and cooled simultaneously to drive the relative humidity $RH_{zone}$ of building zone 712 towards an acceptable relative humidity value (e.g., towards $RH_{setpoint}$).

Referring particularly to FIG. 15, graph 1500 illustrates reheat dehumidification results. Graph 1500 includes an upper temperature plot (comparable to the temperature plot of graph 1400) and a humidity plot (comparable to the humidity plot of graph 1400), according to some embodiments. The time period of the temperature plot and the humidity plot correspond to each other, such that the humidity plot shows relative humidity $RH_{zone}$ of building zone 702 for the same time period of the temperature plot. The temperature plot of graph 1500 includes a setpoint temperature series 1502, and a discrete zone temperature series 1508, and an analog zone temperature series 1406 according to some embodiments.

Relative humidity $RH_{zone}$ of building zone 702 is shown increasing over time duration 1512 (as represented by relative humidity series 1510 increasing over time duration 1512). Time duration 1512 may indicate a time at which building zone 702 is not provided heating or cooling by building equipment 712. In other embodiments, time duration 1512 is representative of a time interval over which building zone 702 is heated by building equipment 712.

Relative humidity $RH_{zone}$ of building zone 702 is shown decreasing over time interval 1514. In some embodiments, time interval 1514 is a time over which building zone 702 is heated by building equipment 712, thereby decreasing the relative humidity $RH_{zone}$ of building zone 702. Building equipment 712 can be operated by PHC 650 to drive the relative humidity $RH_{zone}$ of building zone 702 to an acceptable/comfortable value before occupants arrive at building zone 702. For example, as shown in graph 1500, the relative humidity $RH_{zone}$ of building zone 702 is approximately 45% at the end time of graph 1500 (represented by relative humidity series 1510).

Configuration of Exemplary Embodiments

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can include RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A predictive heating system for a building zone, the predictive heating system comprising:

building equipment operable to affect an environmental condition of the building zone in a heating mode of operation and a cooling mode of operation; and a predictive heating controller comprising processing circuitry configured to:

predict an occupancy time of the building zone over a future time period;

determine a dehumidification time period before the occupancy time of the building zone;

determine a heating time period before the occupancy time of the building zone and separate from the dehumidification time period;

predict a value of the environmental condition of the building zone at an end of a first time period of at least one of the dehumidification time period or the heating time period, wherein the predicted value of the environmental condition determines a second time period of the at least one of the dehumidification time period or the heating time period;

operate the building equipment in the cooling mode of operation to dehumidify the building zone over the first time period or the second time period; and operate the building equipment in the heating mode of operation to heat the building zone over the first time period or the second time period;

wherein the first time period ends within minutes before a transition to the second time period and before the occupancy time.

2. The predictive heating system of claim 1, wherein the processing circuitry of the predictive heating controller is configured to receive occupancy schedules from a scheduling service to estimate when the building zone will be occupied.

3. The predictive heating system of claim 2, further comprising an occupancy sensor, wherein the processing circuitry of the predictive heating controller is further configured to:

collect occupancy sensor information from the occupancy sensor over a time period;

generate a model that predicts occupancy of the building zone; and use the model to predict the occupancy of the building zone to estimate times that the building zone is occupied.

4. The predictive heating system of claim 3, wherein the processing circuitry of the predictive heating controller is configured to use both the received occupancy schedules and the occupancy of the building zone predicted by the model to predict the occupancy of the building zone over the future time period.

5. The predictive heating system of claim 1, wherein the building equipment is single-coil building equipment configured to operate in the cooling mode of operation or the heating mode of operation.

6. The predictive heating system of claim 1, wherein the processing circuitry of the predictive heating controller is configured to receive a user input from a user interface, wherein the user input is a command to activate the predictive heating controller to operate the building equipment to dehumidify the building zone and operate the building equipment to heat the building zone.

7. The predictive heating system of claim 1, wherein determining the dehumidification time period and determining the heating time period comprises determining a start time and an end time of each of the dehumidification time period and the heating time period.

8. A predictive heating controller for a building zone, the predictive heating controller comprising processing circuitry configured to:

operate building equipment to affect an environmental condition of the building zone in a heating mode of operation and a cooling mode of operation;

predict an occupancy time of the building zone over a future time period;

determine a dehumidification time period before the occupancy time of the building zone;

determine a heating time period before the occupancy time of the building zone and separate from the dehumidification time period;

predict a value of the environmental condition of the building zone at an end of a first time period of at least one of the dehumidification time period or the heating time period, wherein the predicted value of the environmental condition determines a second time period of the at least one of the dehumidification time period or the heating time period;

operate the building equipment in the cooling mode of operation to dehumidify the building zone over the first time period or the second time period; and operate the building equipment in the heating mode of operation to heat the building zone over the first time period or the second time period;

wherein the first time period ends within minutes before a transition to the second time period and before the occupancy time.

9. The predictive heating controller of claim 8, wherein the processing circuitry of the predictive heating controller is configured to operate the building equipment to dehumidify the building zone and operate the building equipment to heat the building zone at least partially before the occupancy time of the building zone.

10. The predictive heating controller of claim 8, wherein the processing circuitry of the predictive heating controller is configured to:

receive a humidity measurement of the building zone from a humidity sensor;

receive a temperature measurement of the building zone from a temperature sensor;

operate the building equipment to dehumidify the building zone over the dehumidification time period until the humidity measurement of the building zone is less than a humidity threshold value; and operate the building equipment to heat the building zone over the heating time period until the temperature measurement of the building zone is within an acceptable temperature range.

11. The predictive heating controller of claim 8, wherein the processing circuitry of the predictive heating controller is configured to receive occupancy schedules from a scheduling service to estimate when the building zone will be occupied.

12. The predictive heating controller of claim 11, wherein the processing circuitry of the predictive heating controller is further configured to:

collect occupancy sensor information from an occupancy sensor over a time period;

generate a model that predicts occupancy of the building zone; and use the model to predict the occupancy of the building zone to estimate times that the building zone is occupied.

13. The predictive heating controller of claim 12, wherein the processing circuitry of the predictive heating controller is further configured to use both the received occupancy schedules and the occupancy of the building zone predicted by the model to predict the occupancy of the building zone over the future time period.

14. The predictive heating controller of claim 8, wherein the building equipment is single-coil building equipment configured to operate in the cooling mode of operation or the heating mode of operation.

15. The predictive heating controller of claim 8, wherein the predictive heating controller is configured to receive a user input from a user interface, wherein the user input is a command to activate the predictive heating controller to operate the building equipment to dehumidify the building zone and operate the building equipment to heat the building zone.

16. A method for dehumidifying and heating a building zone, the method comprising:

operating building equipment to affect an environmental condition of the building zone in a heating mode of operation and a cooling mode of operation;

predicting an occupancy time of the building zone over a future time period;

determining a dehumidification time period before the occupancy time of the building zone;

determining a heating time period before the occupancy time of the building zone and separate from the dehumidification time period;

predicting a value of the environmental condition of the building zone at an end of a first time period of at least one of the dehumidification time period or the heating time period, wherein the predicted value of the environmental condition determines a second time period of the at least one of the dehumidification time period or the heating time period;

operating the building equipment in the cooling mode of operation to dehumidify the building zone over the first time period or the second time period; and operating the building equipment in [[a]] the heating mode of operation to heat the building zone over the first time period or the second time period;

wherein the first time period ends within minutes before a transition to the second time period and before the occupancy time.

17. The method of claim 16, further comprising receiving occupancy schedules from a scheduling service to estimate when the building zone will be occupied.

18. The method of claim 17, further comprising:

collecting occupancy sensor information from an occupancy sensor over a time period;

generating a model that predicts occupancy of the building zone; and using the model to predict the occupancy of the building zone to estimate times that the building zone is occupied.

19. The method of claim 18, further comprising using both the received occupancy schedules and the occupancy of the building zone predicted by the model to predict the occupancy of the building zone over the future time period.

20. The method of claim 16, wherein the building equipment is single-coil building equipment configured to operate in the cooling mode of operation or the heating mode of operation.

21. The method of claim 16, further comprising receiving a user input from a user interface, wherein the user input is a command to activate operation of the building equipment to dehumidify the building zone and to heat the building zone.

* * * * *